US007950538B2

(12) United States Patent
Zang et al.

(10) Patent No.: US 7,950,538 B2
(45) Date of Patent: May 31, 2011

(54) DISPLAY ASSEMBLY WITH ADJUSTABLE SHELVES

(75) Inventors: Dathan G Zang, Grand Haven, MI (US); Gregory D Gavin, Grand Haven, MI (US); Thomas J Nook, Grand Haven, MI (US)

(73) Assignees: Harbor Industries, Inc., Grand Haven, MI (US); Altria Sales & Distribution Inc., Richmond, VA (US)

( * ) Notice: Subject to any disclaimer, the term of this patent is extended or adjusted under 35 U.S.C. 154(b) by 1143 days.

(21) Appl. No.: 11/602,791

(22) Filed: Nov. 21, 2006

(65) Prior Publication Data

US 2008/0087621 A1 Apr. 17, 2008

Related U.S. Application Data

(60) Provisional application No. 60/850,916, filed on Oct. 11, 2006.

(51) Int. Cl.
*A47B 43/00* (2006.01)
*A47B 47/00* (2006.01)
*A47B 57/00* (2006.01)

(52) U.S. Cl. ..... 211/187; 108/147.16

(58) Field of Classification Search ..... 211/134, 211/187, 186, 188, 153, 26, 189, 190, 207, 211/208, 90.02; 312/107, 408; 108/106, 108/107, 147.11, 147.16, 109, 108
See application file for complete search history.

(56) References Cited

U.S. PATENT DOCUMENTS 775,496 A * 11/1904 Parsons ..... 108/106
844,754 A 2/1907 Sardou et al.
1,556,711 A * 10/1925 Pietrzycki ..... 312/107
1,619,312 A * 3/1927 Pietrzycki ..... 312/280
1,630,105 A * 5/1927 Bernard ..... 211/50
3,129,042 A 4/1964 Liener-Kunde
3,130,693 A 4/1964 Shell
3,132,609 A * 5/1964 Chesley ..... 108/106
3,324,595 A * 6/1967 Loomis ..... 410/137
3,648,419 A * 3/1972 Marks ..... 52/36.6
3,885,846 A 5/1975 Chuang et al.
4,489,995 A 12/1984 Barr
4,498,593 A 2/1985 Silver
4,508,231 A 4/1985 Honickman
4,537,316 A 8/1985 Simon et al.
4,747,025 A 5/1988 Barton
4,762,236 A 8/1988 Jackle, III et al.
4,771,898 A 9/1988 Howard et al.
(Continued)

*Primary Examiner* — Darnell M Jayne
*Assistant Examiner* — Stanton L Krycinski
(74) *Attorney, Agent, or Firm* — Van Dyke, Gardner, Linn & Burkhart, LLP

(57) ABSTRACT

A modular display assembly for displaying merchandise includes a pair of opposite side members and a plurality of shelves adjustably mounted to the side members. The side members have forward and rearward facing edges, which include a plurality of protrusions spaced therealong. The shelf includes a mounting assembly, which includes a handle and first and second movable arms for mounting the shelf to the side members. The arms are configured to engage at least one of the protrusions to limit vertical movement along the side members when the arms are engaged with the edges of the side members. The shelf is positionable between the side members at a desired location and the handle is movable to move the arms into engagement with the forward and rearward facing edges to substantially clamp the side member between the arms and thus to fixedly secure the shelf to and between the side members.

35 Claims, 33 Drawing Sheets

U.S. PATENT DOCUMENTS 4,887,783 A 12/1989 Franklin
4,934,645 A 6/1990 Breslow
5,048,699 A 9/1991 Trevaskis
5,228,579 A 7/1993 Kaufman
5,452,875 A 9/1995 Kern
5,771,991 A 6/1998 Fresco
5,794,794 A 8/1998 Hull
5,855,283 A 1/1999 Johnson
5,918,750 A * 7/1999 Jackson ..... 211/189
6,164,462 A 12/2000 Mumford
6,199,705 B1 3/2001 Portner
6,199,706 B1 3/2001 Shea
6,375,015 B1 4/2002 Wingate
6,467,637 B2 10/2002 Riga
6,659,293 B1 12/2003 Smith
6,773,080 B2 8/2004 Chen et al.
6,811,043 B2 11/2004 Perkins et al.
7,175,034 B2 2/2007 Nook et al.
7,275,648 B2 * 10/2007 Segovia, Jr. ..... 211/134
2008/0000859 A1 * 1/2008 Yang et al. ..... 211/90.02

* cited by examiner

DISPLAY ASSEMBLY WITH ADJUSTABLE SHELVES

CROSS REFERENCE TO RELATED APPLICATION

The present application claims benefit of U.S. provisional application Ser. No. 60/850,916, filed Oct. 11, 2006, which is hereby incorporated herein by reference in its entirety.

FIELD OF THE INVENTION

The present invention relates generally to display stands or assemblies for displaying merchandise and, more particularly, to display stands with adjustable shelves.

BACKGROUND OF THE INVENTION

Display cabinets or systems are known that provide a plurality of shelves for supporting and displaying products thereon, such as for supporting and displaying packages of cigarettes and the like. The shelves may be attached to the display cabinet in a desired arrangement. Typically, the shelves are fixedly attached to either sidewalls or a back of the display cabinet and are not readily adjustable or moved to a different location. Thus, the shelves are typically set to a particular arrangement and the display cabinet is not readily adapted to displaying different products or displaying the products in a different manner.

SUMMARY OF THE INVENTION

The present invention provides a modular display assembly that includes a plurality of shelves adjustably mounted to opposite side walls or side members. The shelves are mounted to the side members via clamping arms that clamp to the forward and rearward edge portions of the side members to substantially secure the shelves to the side members at a desired location. The modular display assembly may include two or more display modules positioned adjacent to one another, with the adjacent side members being adjoined to connect the modules together.

According to an aspect of the present invention, a modular display assembly for displaying merchandise includes a pair of opposite side members and a plurality of shelves adjustably mounted to the side members. Each of the side members has a forward facing edge and a rearward facing edge, and each of the forward and rearward facing edges includes a plurality of protrusions spaced therealong. Each of the shelves includes a mounting assembly at least one end thereof. The mounting assembly includes a handle and first and second arms for engaging the forward and rearward facing edges of the side members to mount the shelf to the side members. Each of the arms is configured to engage at least one of the protrusions to limit vertical movement along the side members when the arms are engaged with the edges of the side members. The first and second arms are movably mounted to the shelf and are movable via movement of the handle. The shelf is positionable between the side members at a desired location and the arms are positioned at selected ones of the protrusions. The handle is movable to engage the first arm with one of the forward and rearward facing edges and the second arm with the other of the forward and rearward facing edges to substantially clamp the side member between the arms.

The shelves may include a mounting assembly at each end of the shelf, with each mounting assembly engaging the forward and rearward facing edges of a respective one of the side members. In one form, the first arm may be slidably mounted to the shelf and the second arm may be pivotally mounted to the shelf. Pivotal movement of the handle thus may impart a translational movement of the first arm, which in turn may impart a pivotal movement of the second arm to engage the arms with the protrusions.

The side members of the modular display assembly may comprise first and second side members with a plurality of shelves mounted thereto, and the modular display assembly may include third and fourth side members with a plurality of shelves mounted thereto. The third side member may be positioned adjacent to and connected to the second side member to join two display modules together. A product tray module may be attached to a forward portion of the joined second and third side members to substantially conceal at least a portion of the second and third side members.

Therefore, the present invention provides a modular display assembly that facilitates easy installation and adjustment of shelves along and between the side members of the display assembly. The shelves are mounted to the side members via a mounting assembly that substantially clamps the side members to substantially fixedly retain the shelf to the side members at the desired height or location. The clamping of the side members by the mounting assembly provides enhanced structural rigidity to the modular display assembly and is readily adjustable to move the display shelves to different locations along the side members. Two or more display modules may be positioned adjacent to one another and may be readily adjoined to form a unitary modular display assembly. The side members may be substantially covered or concealed between corresponding shelves of the adjacent display modules via one or more product tray modules that attach at a forward edge of the joined adjacent side members and that may support one or more products or items thereon, whereby the shelves of the display assembly may appear to extend substantially continuously across both display modules and between the side members at opposite sides of the display assembly, such as between the first and fourth side members of the modular display assembly.

These and other objects, advantages, purposes and features of the present invention will become apparent upon review of the following specification in conjunction with the drawings.

DESCRIPTION OF THE PREFERRED EMBODIMENTS

Figure 1:
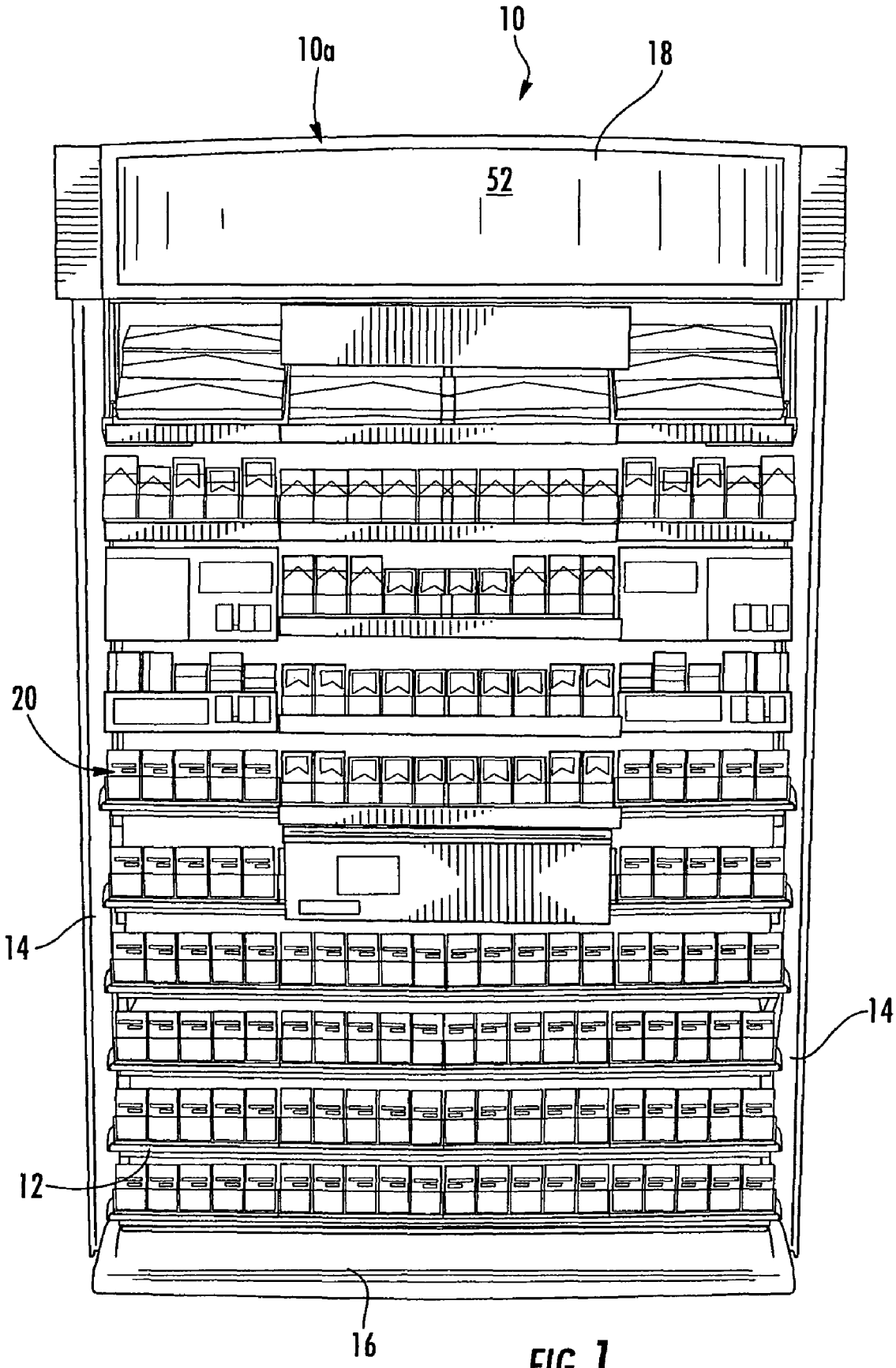
FIG. 1 is a front elevation of a display assembly in accordance with the present invention.

Referring now to the drawings and the illustrative embodiments depicted therein, a display cabinet assembly 10 includes a plurality of shelves 12 attached to and supported between a pair of opposite side members 14 (FIGS. 1-5). The side members 14 may attach to and extend upward from a base portion 16, and may attach to a header or display portion 18 at an upper end thereof. The shelves may support various trays or product holders 20 thereon, and may be adjustably or removably mounted to or attached to side members 14 via a mounting assembly 22 (FIGS. 16 and 18-21), as discussed below. In the illustrated embodiment, the trays 20 and shelves 12 support packages of cigarettes and cartons of cigarettes, but could support any other product thereon, without affecting the scope of the present invention.

Figure 2A:
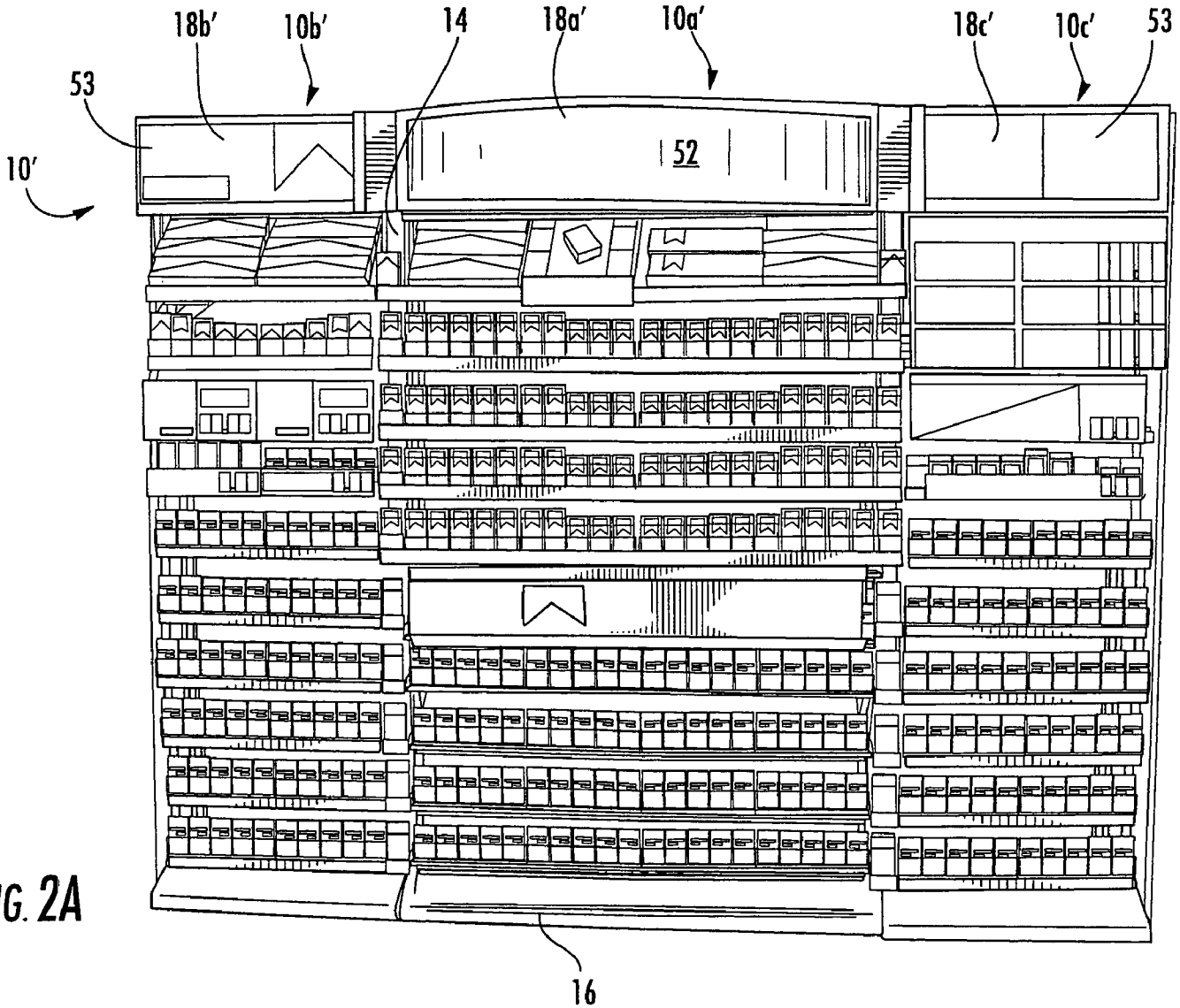
FIG. 2A is a front elevation of another display assembly of the present invention, with three display modules connected together.
Figure 2B:
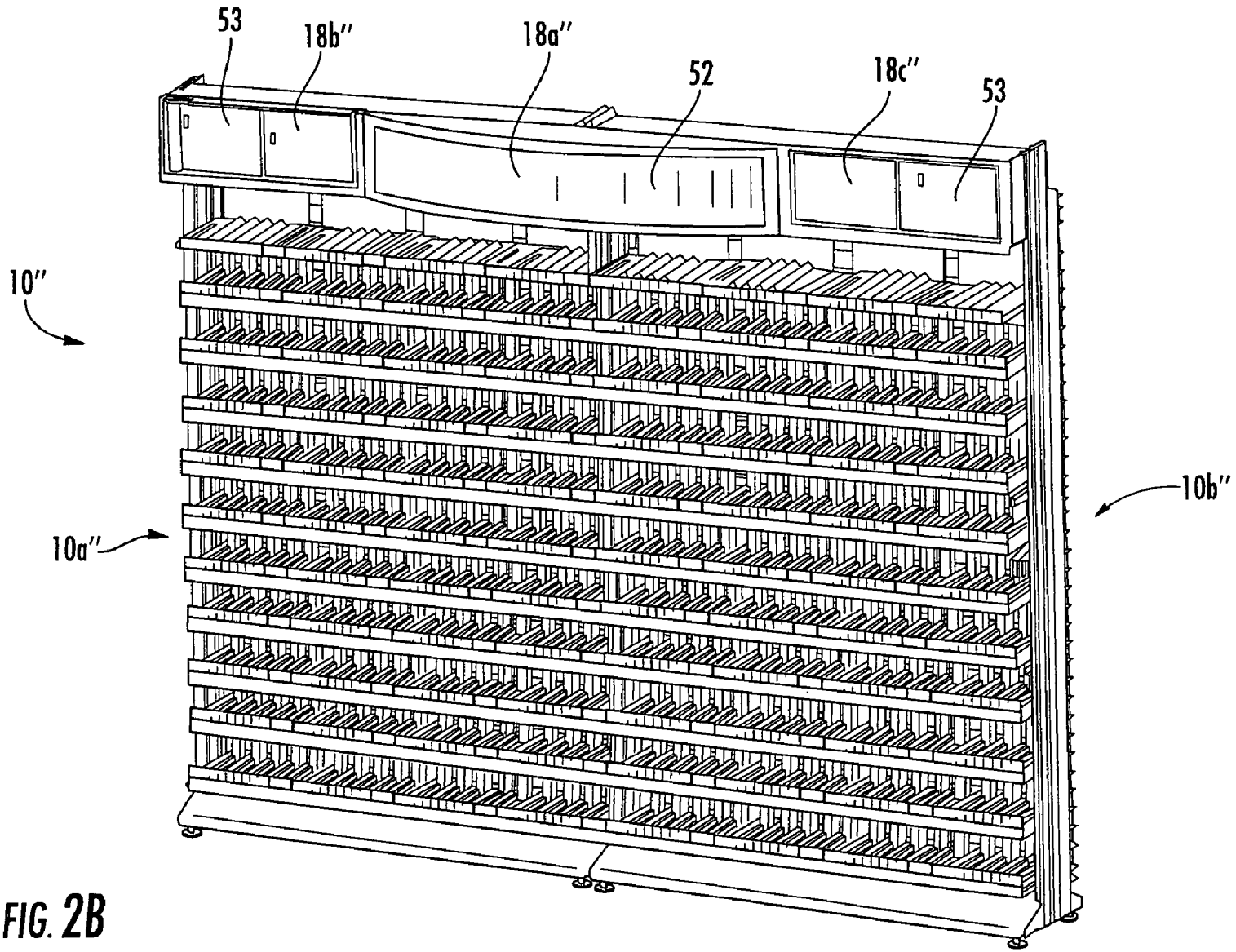
FIG. 2B is a front elevation of another display assembly of the present invention, with two display modules connected together.
Figure 3:
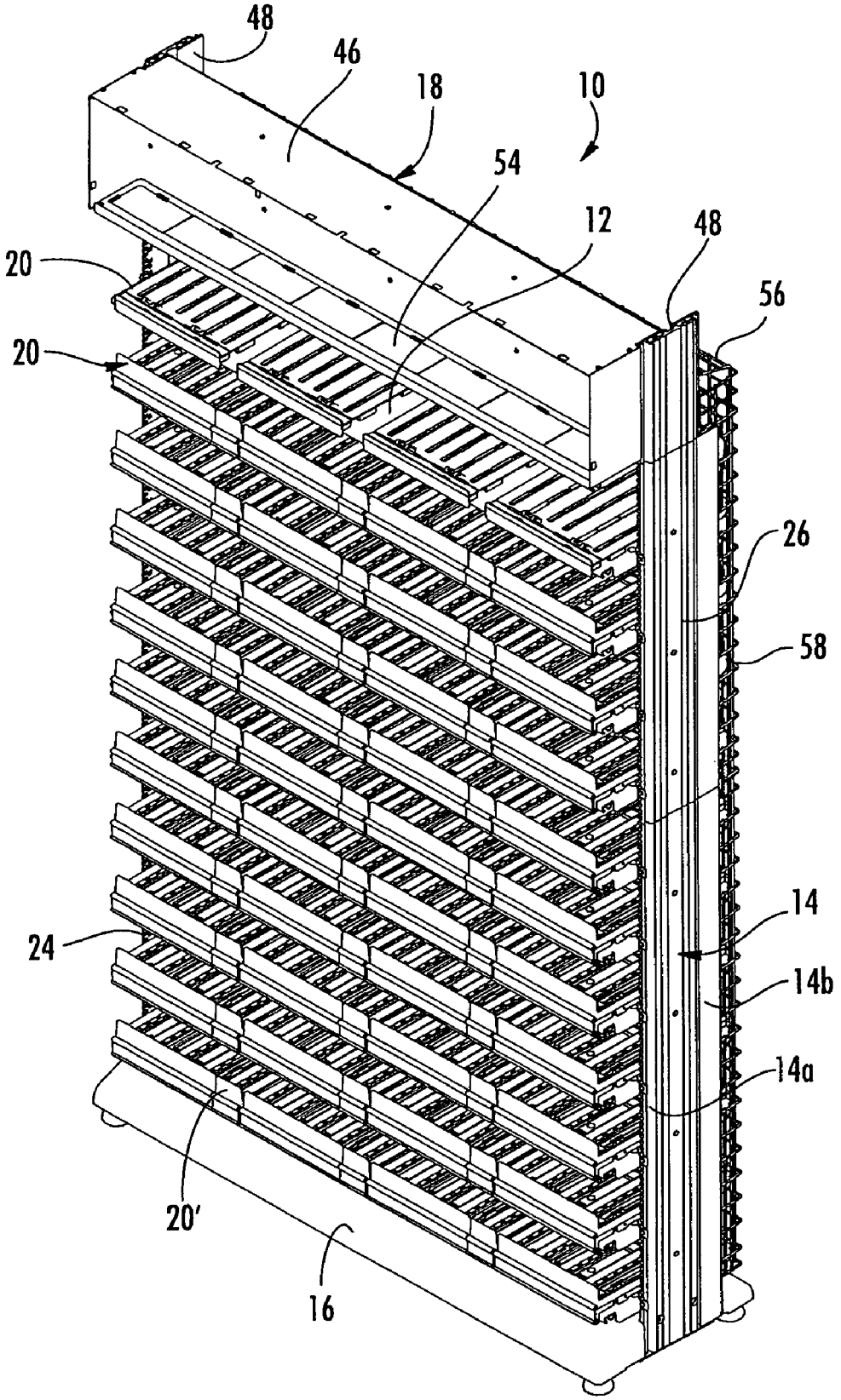
FIG. 3 is a perspective view of a display assembly of the present invention.

In the illustrated embodiment of FIG. 1, the display cabinet assembly 10 includes a single display module 10*a*. However, and as shown in FIG. 2A, a display cabinet assembly 10' may include two or more display cabinet modules (such as the three modules 10*a*', 10*b*', 10*c*' of FIG. 2A) joined together at opposed side members 14, as also discussed below. Further, and as shown in FIG. 2B, a display cabinet assembly 10" may include two display cabinet modules 10*a*" and 10*b*" joined together at opposed side members 14, such as discussed below. As can be seen with reference to FIGS. 2A and 2B, the display assembly of the present invention may be assembled using various width display modules, yet may provide any desired header across the top or upper end or portion of the display assembly. For example, the three module display assembly 10' of FIG. 2A includes a generally central header sign or portion or bezel 18*a*' at the center module 10*a*', with two side header signs or portions or bezels 18*b*', 18*c*', each at a respective side module 10*b*', 10*c*'. However, and with reference to FIG. 2B, the two module display assembly 10" may include a generally central header sign or portion or bezel 18*a*" that spans a portion of both display modules 10*a*", 10*b*", with two side header signs or portions or bezel 18*b*", 18*c*", each at a side portion or region of the two modules 10*a*", 10*b*". Thus, the display assembly of the present invention may be readily configured to provide a variety of display and shelf configurations using one or more display modules (of the same or different widths), to provide enhanced flexibility of the display assembly, as discussed in greater detail below.

Figure 4:
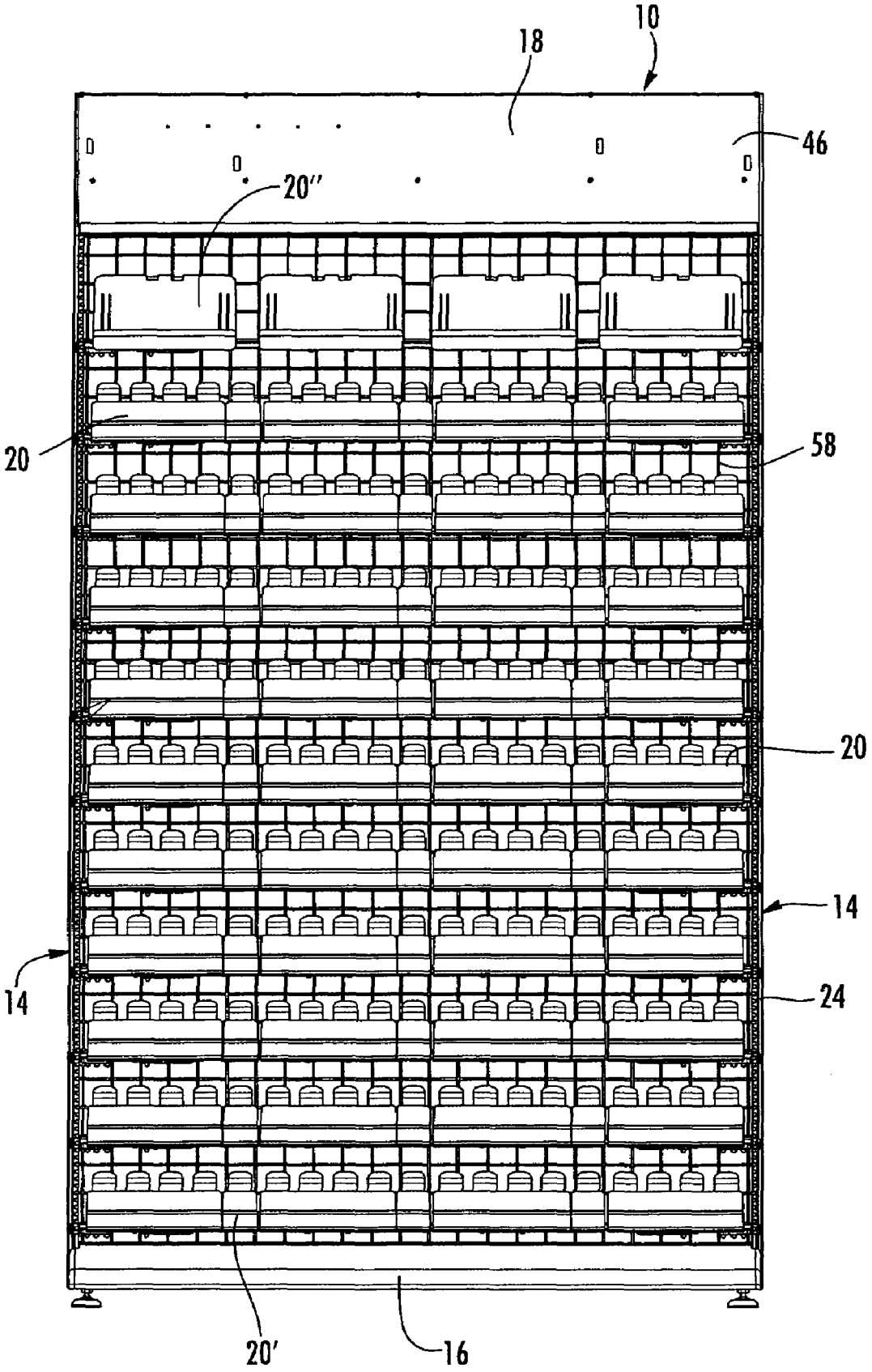
FIG. 4 is a front elevation of the display assembly of FIG. 3.
Figure 5:
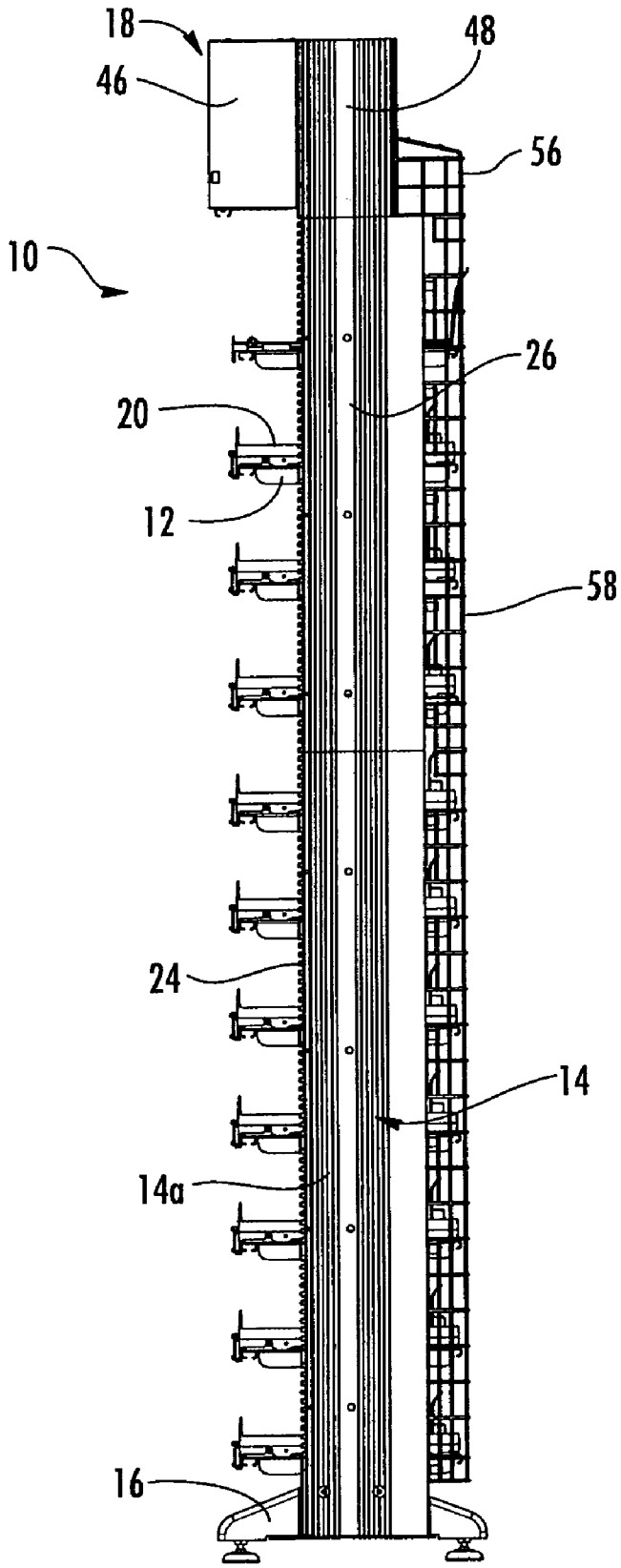
FIG. 5 is a side elevation of the display assembly of FIGS. 3 and 4.
Figure 6:
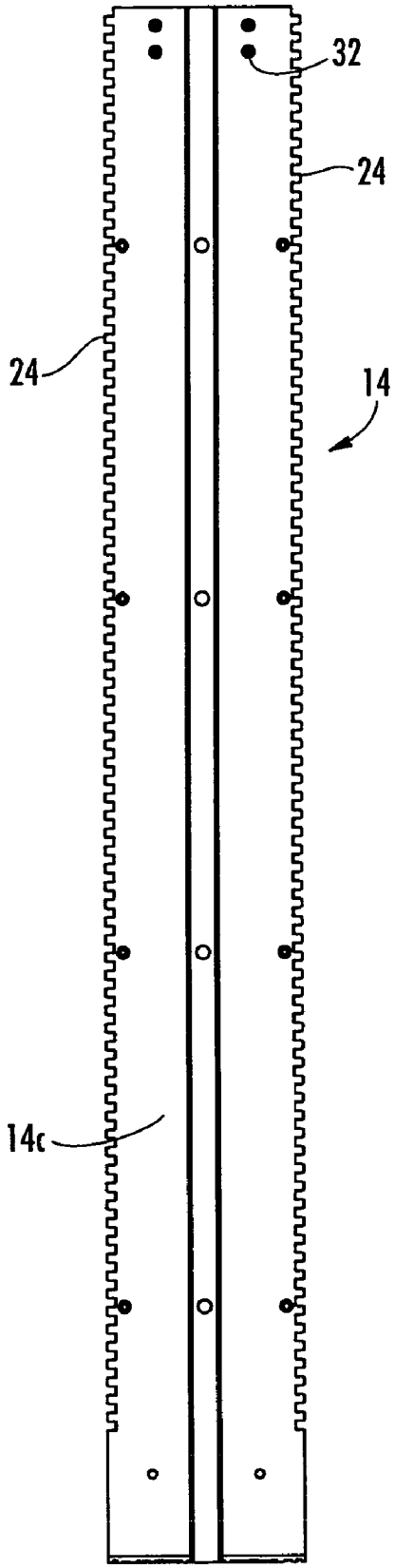
FIG. 6 is a side elevation of a side member of the display assembly of the present invention.

As best shown in FIGS. 3-10, each side member 14 comprises an elongated side member having a plurality of protrusions or tabs 24 extending forwardly from a forward edge portion 14*a* of side member 14 and rearwardly from a rearward edge portion 14*b* of side member 14. The protrusions 24 extend outwardly and engage respective mounting arms of the mounting assembly 22 retain the shelves at the desired height and location along the side members 14, as discussed below. As can be seen in FIG. 6, the inner surface 14*c* of the side members may include marking or indicia thereon that indicate a height or location along the side member, so that the shelves may be readily attached to opposite side members at the appropriate height or location along the side members, so that the shelves are substantially horizontal when attached thereto. The outer surface 14*d* (FIG. 7) of side member 14 may comprise ribs or grooves or the like so that the outer surfaces of two opposed side members may generally mate together (such as shown in FIG. 8A) to facilitate alignment of the side members of adjacent cabinet modules.

Figure 7:
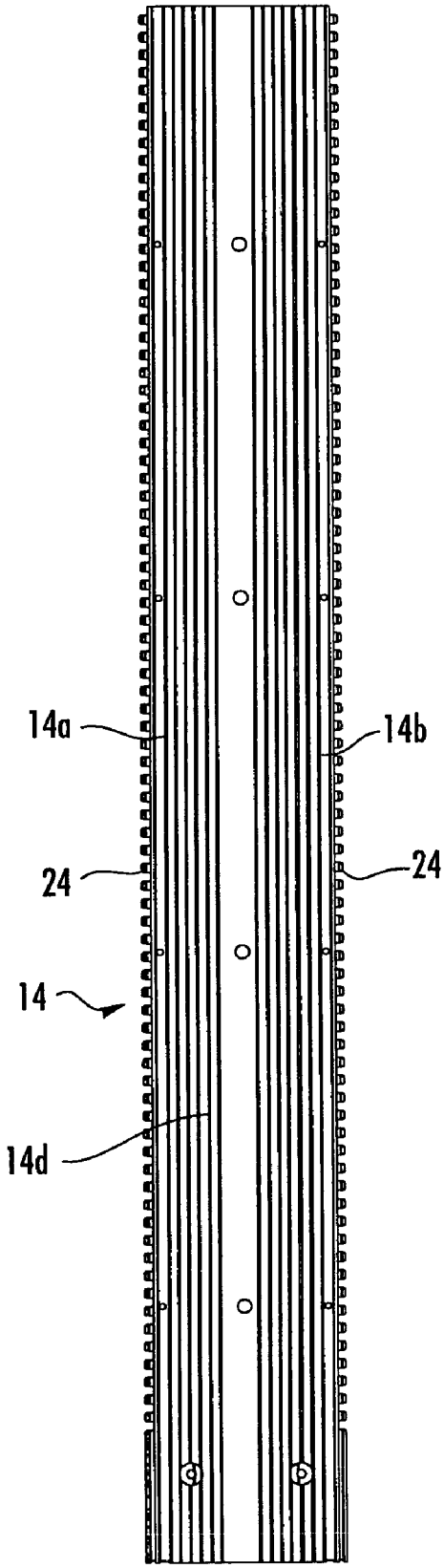
FIG. 7 is an opposite side elevation of the side member of FIG. 6.

Optionally, side members 14 may be a predetermined length for a particular display cabinet height, and may be readily extended for a taller display cabinet. For example, side members 14 may be as shown in FIGS. 6 and 7 (with the indicia markings from one to forty), and an extension side member 26 (FIGS. 9 and 10) may be connected to the upper end of the side member 14 to extend the height of the side members of the display cabinet for different applications. In the illustrated embodiment, side members 14 include the indicia or markings from "01" to "40", while extension side members 26 include markings from "41" to "55" on their inner surfaces 26*c*.

Figure 13:
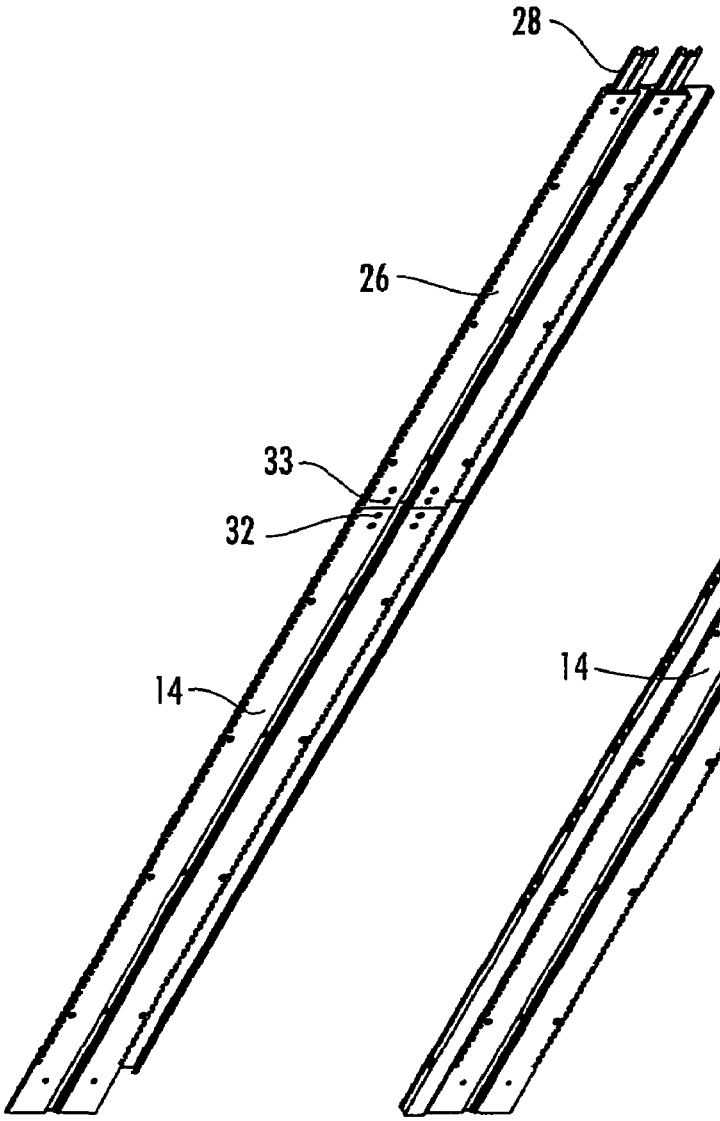
FIGS. 13 and 14 are perspective views of side member sections connected together in accordance with the present invention.
Figure 14:
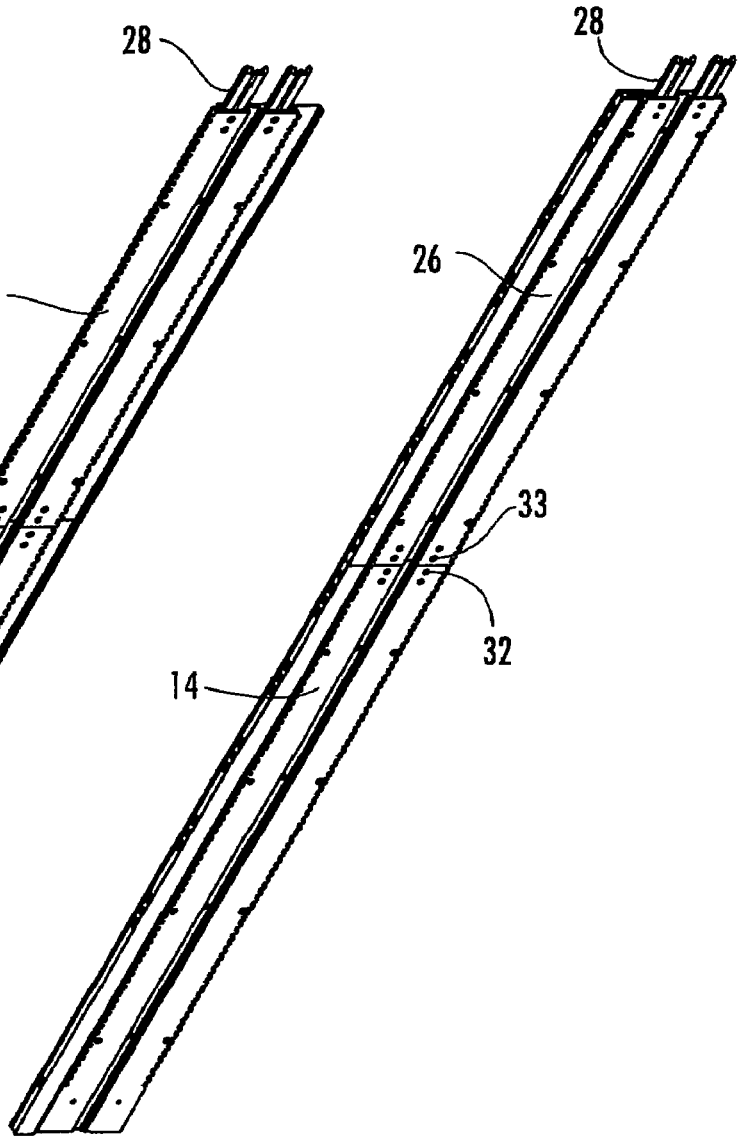

The side members 14, 26 may be readily connected together via a pair of connecting elements or bayonets 28 (FIGS. 11-14), which are received in channels 14*e* at the upper end of side member 14 and corresponding channels (not shown) at the lower end of side member 26, so as to properly align and secure the side members 14, 26 together when the opposed ends of the side members are moved into engagement with one another. In the illustrated embodiment, the side members 14, 26 include passageways 30 (FIG. 8) formed therein for slidably receiving and frictionally retaining the bayonet 28 therein. The bayonets 28 thus may be received within the channels or passageways 14*e* and the opposed ends of the side members 14, 26 may be pressed or moved together, whereby one or more fasteners may be inserted through openings 32 at the upper end of side member 14 and openings 33 at the lower end of side member 26 to secure the bayonets relative to the side members 14, 26 and, thus, to secure the side members relative to one another. As shown in FIGS. 13 and 14, additional connecting elements or bayonets 28 may be inserted into the upper end of the extending side members 26, such as for connecting to a further extension side member or to a header portion 18, as discussed below.

Figure 8:
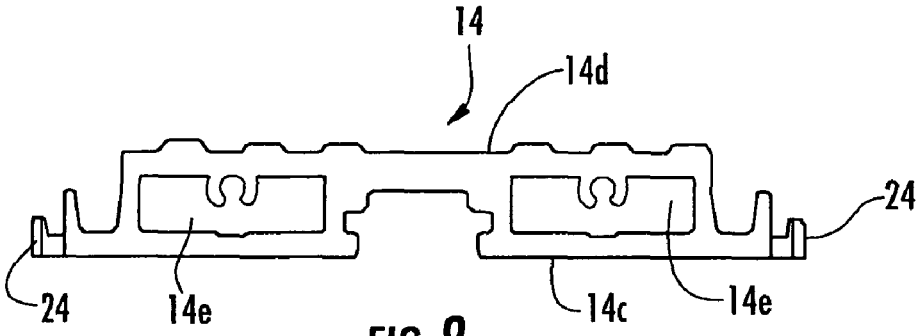
FIG. 8 is an end elevation of the side member of FIGS. 6 and 7.
Figure 9:
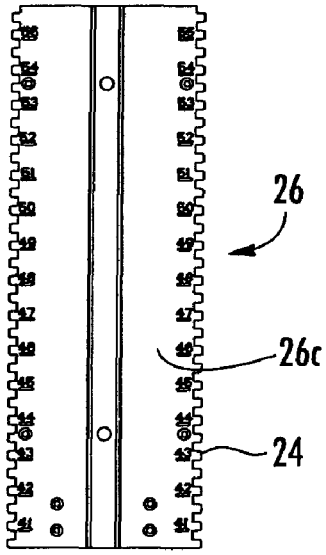
FIGS. 9 and 10 are opposite side elevations of an upper side member section of the present invention.
Figure 10:
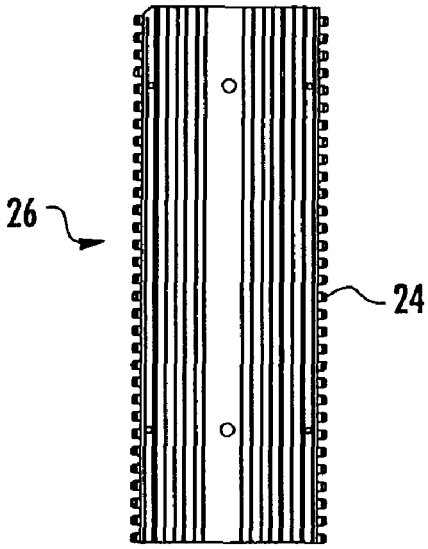
Figure 11:
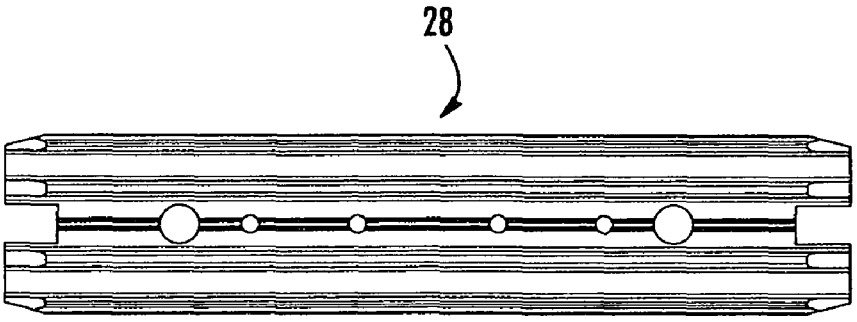
FIG. 11 is a connecting element suitable for connecting the side member section of FIGS. 9 and 10 to the side member of FIGS. 6 and 7.
Figure 12:
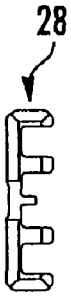
FIG. 12 is an end elevation of the connecting element of FIG. 11.
Figure 8A:
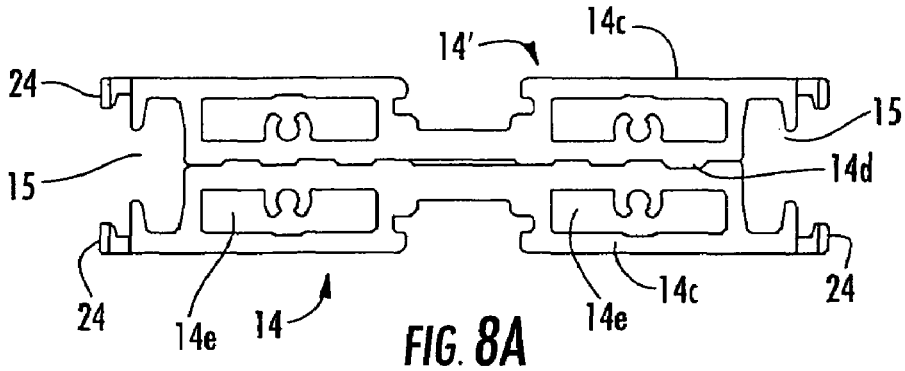
FIG. 8A is an end elevation of a pair of side members joined together at the sides of adjacent display modules.

As can be seen with reference to FIGS. 8 and 8A, the outer surface 14*d* of side member 14 may include a plurality of ridges and grooves formed therealong. The ridges or grooves are spaced so that a second side member 14' (FIG. 8A), such as a side member of another display module 10*b*, 10*c*, may be placed alongside and against the outer surface of the first side member 14, with the grooves and channels of the side members generally aligning so that they substantially mesh together to form a double-sided side member having a pair of forward facing edges 14*a* and protrusions 24 and a pair of rearward facing edges 14*b* and protrusions 24, such as for attaching to shelves of an additional cabinet module, as discussed below. As can be seen in FIG. 8A, the two side members 14, 14' may be joined together (such as via a fastener or bolt or the like extending at least partially through the side members to retain them together), and may define parallel and spaced apart protrusions 24 for connecting to respective shelf mounting assemblies 22, as discussed below. The two side members 14, 14' may also define a channel 15 extending longitudinally along the side members for receiving an electrical wire or the like. Optionally, the forward edge portions 14*a*, 14*a*' of the joined side members 14, 14' and/or channel 15 may be configured to receive a mounting portion of a product tray module 44 (FIGS. 29A-32), such as a single product tray 44 (discussed below) that mounts at the forward edges of the side members to substantially conceal the side members between adjacent shelves of the respective display cabinet modules, as also discussed below.

Figure 15:
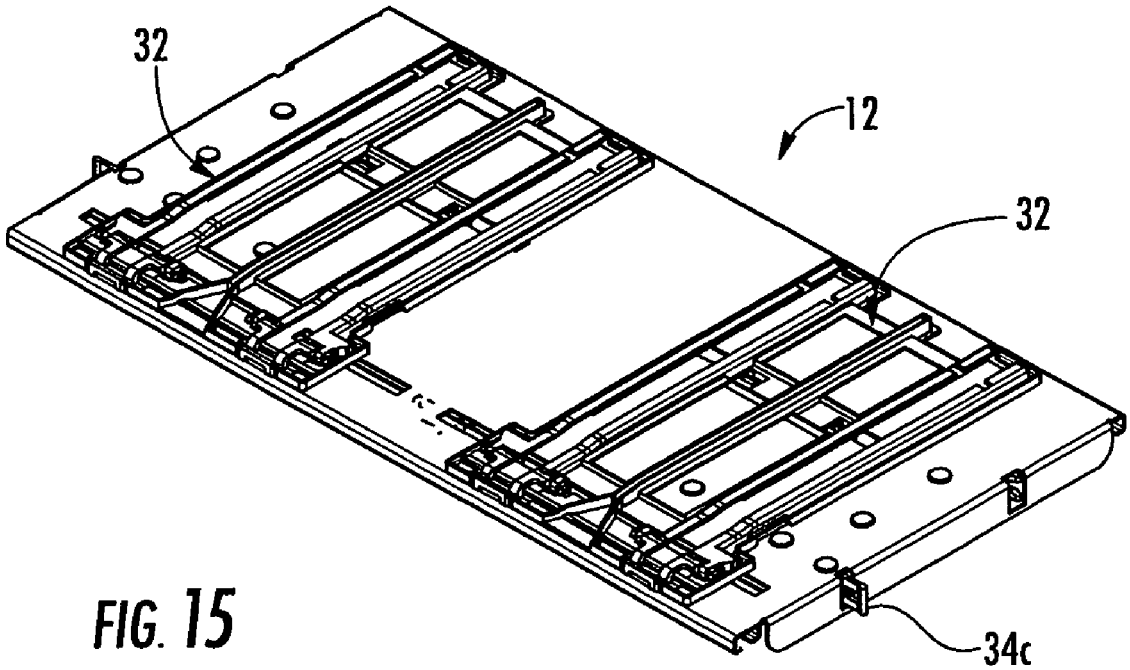
FIG. 15 is an upper perspective view of a shelf for mounting to the side members in accordance with the present invention.
Figure 16:
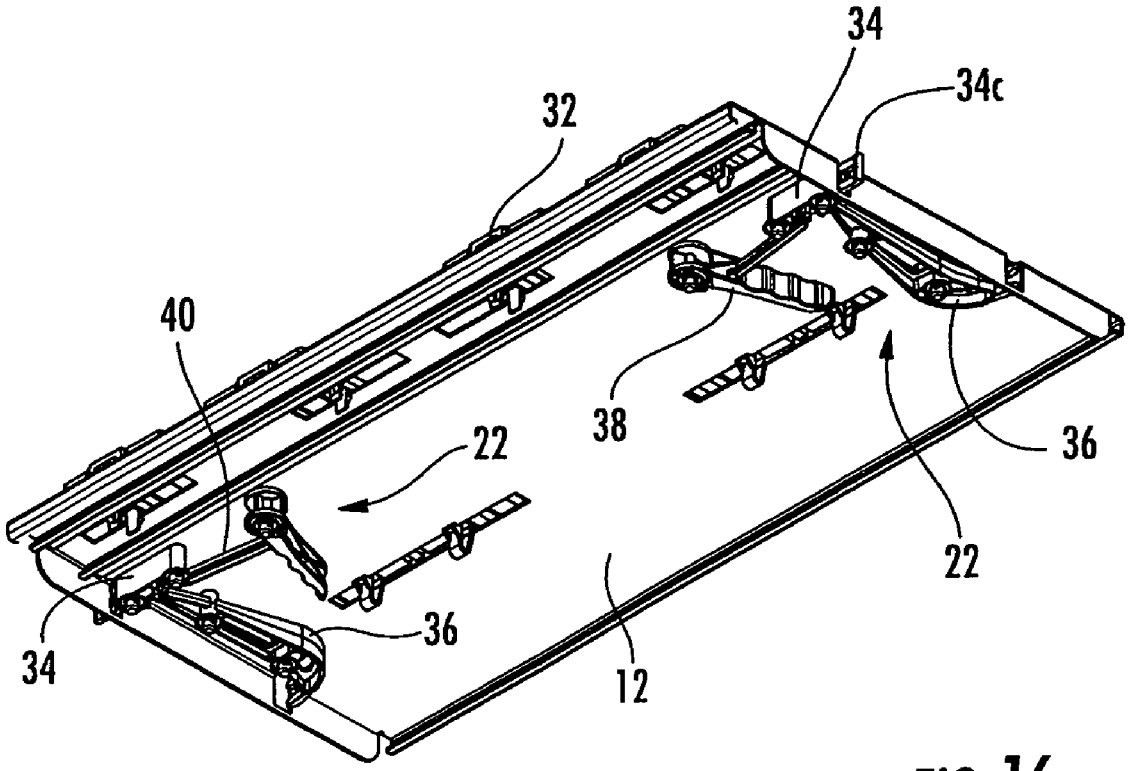
FIG. 16 is a lower perspective view of the shelf of FIG. 15.
Figure 17A:
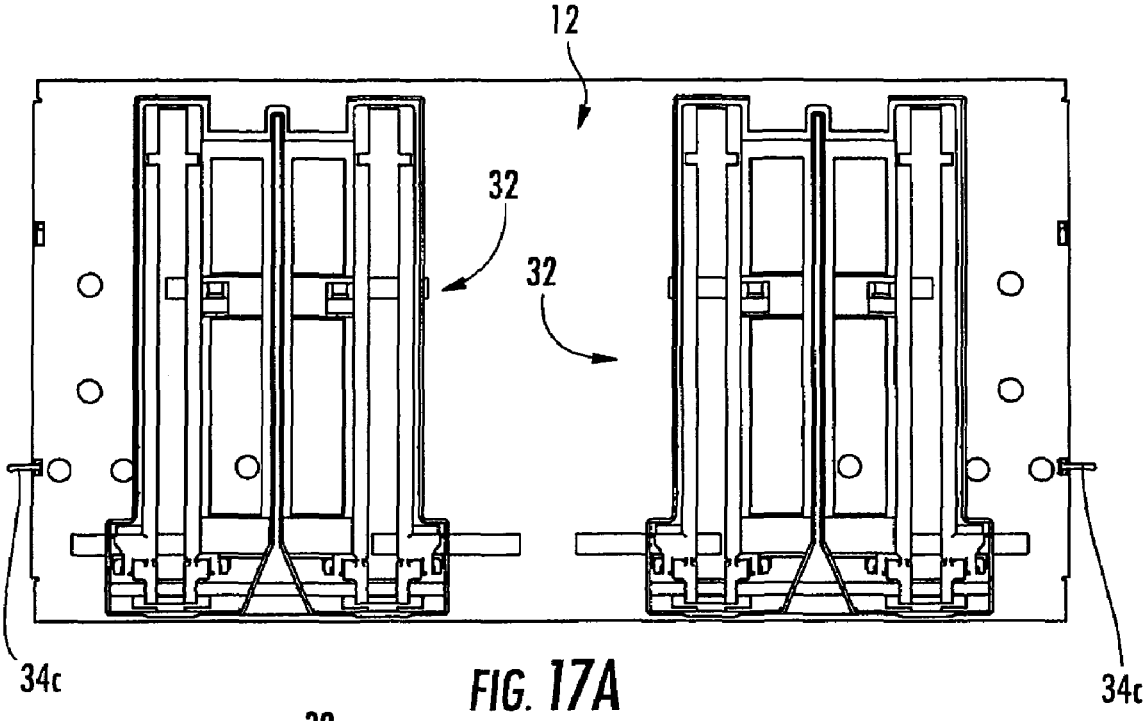
FIG. 17A is an upper plan view of the shelf of FIGS. 15 and 16.
Figure 17B:
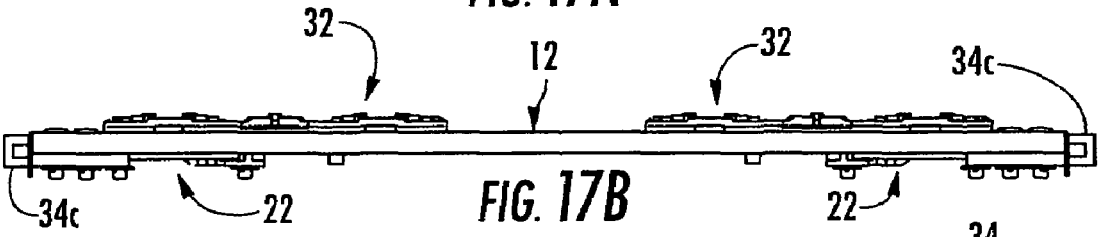
FIG. 17B is an end elevation of the shelf of FIGS. 15-17A.
Figure 17C:
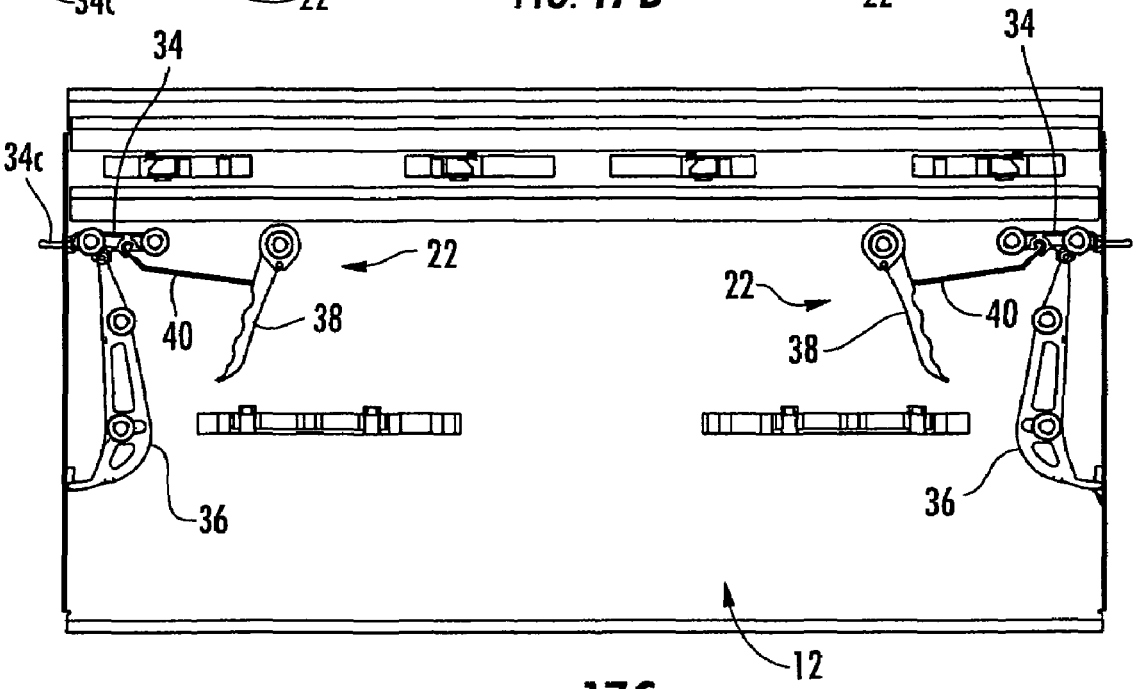
FIG. 17C is an underside plan view of the shelf of FIGS. 15-17B.

As shown in FIG. 15, each shelf 12 may include a tray track or upper tray attachment portion 32 for attaching a desired or appropriate tray or product support or holder 20 thereon. For example, a tray or tray module 20 may be secured to the track or upper tray attachment portion 32 of a respective shelf 12, and/or the tray may be movably attached to the upper tray attachment portion 32, whereby the tray may pivot (such as about a generally horizontal pivot angle at a forward end of the tray) and/or slide (such as forwardly along the shelf), such as can be seen with reference to FIGS. 25 and 26, or may be otherwise movable or adjustable, such as to assist in loading and unloading of the trays at the shelves, such as discussed in greater detail below.

Figure 18:
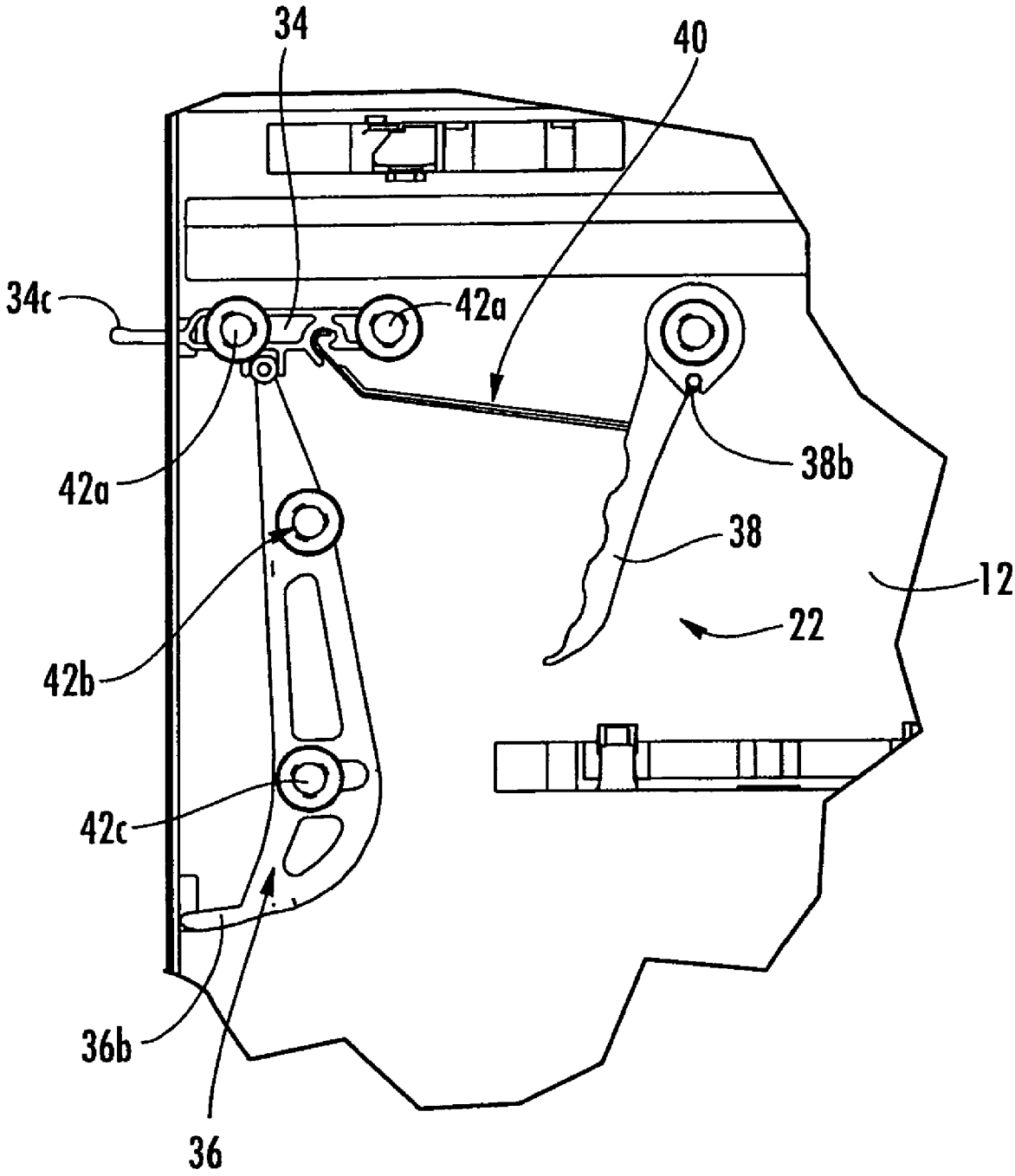
FIG. 18 is an enlarged plan view of a mounting assembly for mounting or attaching the shelf to one of the side members in accordance with the present invention.
Figure 19:
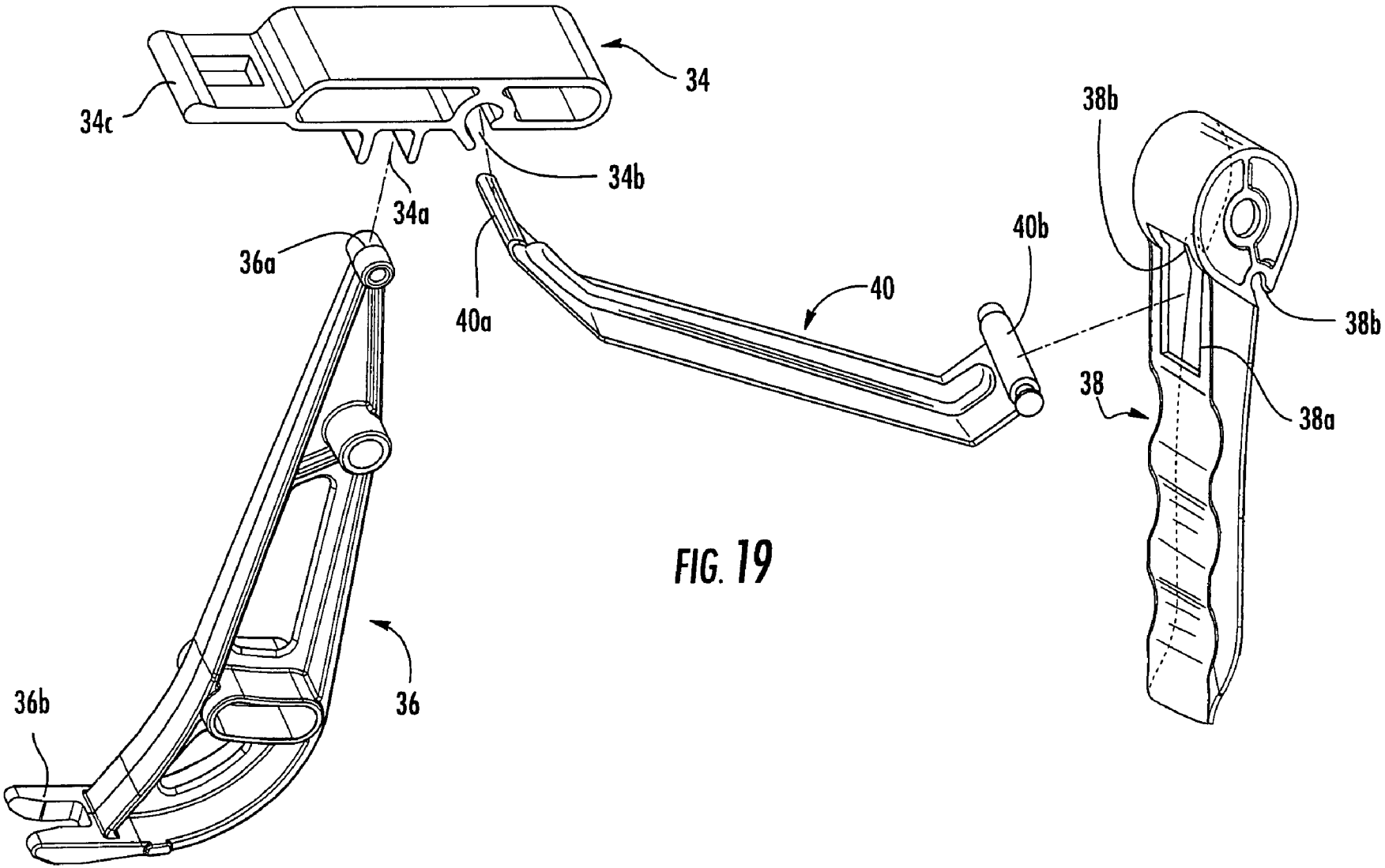
FIG. 19 is an exploded perspective view of the mounting assembly of FIG. 18.
Figure 20B:
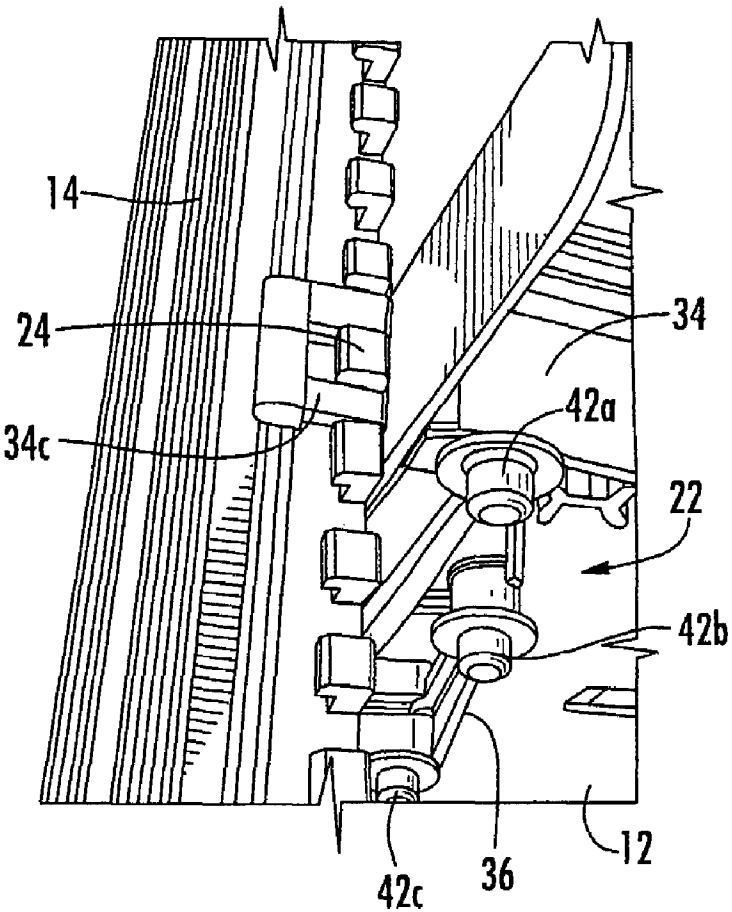
FIGS. 20A and 20B are perspective views of the mounting arm of the mounting assembly as it is moved into engagement with a tab at the forward edge of the side member.
Figure 20A:
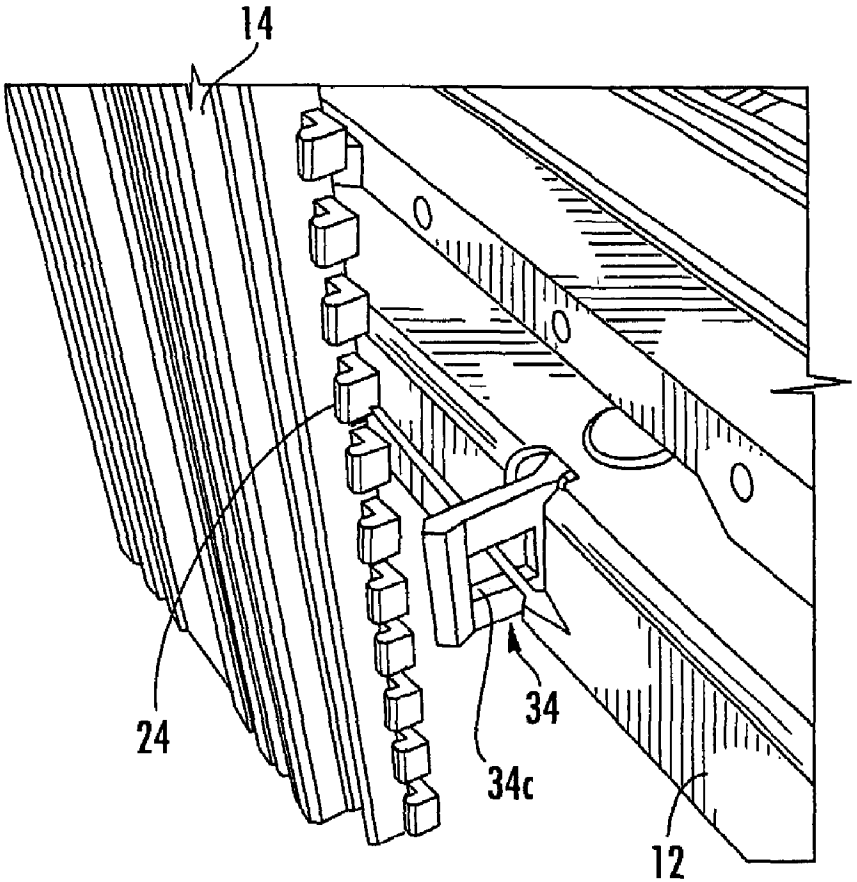

Each shelf 12 includes a pair of mounting assemblies 22 at the underside of the shelf for engaging the respective or adjacent side member 14 to attach the shelf 12 to the side members 14, as discussed below. As best shown in FIGS. 17C-19, mounting assembly 22 includes a first engaging arm 34 and a second engaging arm 36 for engaging the respective protrusions of the side member 14. The engaging arms 34, 36 are moved into engagement with the protrusions 24 via manual movement of a handle portion 38 and a connecting spring or connecting element 40. In the illustrated embodiment, arm 34 is slidably or movably attached to the lower surface of shelf 12, such as via a pair of sliding bushings 42*a* or the like, and is translationally movable inward and outward at the side of the shelf via pivotal movement of handle 38. The other arm 36 is pivotally mounted to the lower surface of the shelf 12, such as via a pivot bushing 42*b* or the like, and is pivotable about the pivot axis or bushing 42*b* via the translational movement or arm 34. As can be seen in FIGS. 18 and 19, arm 34 includes a receiving portion 34*a* for receiving an end portion 36*a* of arm 36 therein, such that translational movement of arm 34 imparts a corresponding pivotal movement of arm 36 about the pivot axis or bushing 42*b*. Arm 34 may also be retained at shelf 12 via a guide pin or bushing 42*c* to assist in maintaining alignment of arm 36 during its pivotal movement, and to limit the pivotal movement of the arm 36 within a desired or appropriate range.

Connecting element 40 is connected between arm 34 and handle 38 so that pivotal movement of handle 38 imparts a generally translation movement of arm 34. In the illustrated embodiment, arm 34 includes notch or groove 34*b* for receiving an end 40*a* of connecting element 40 therein, while handle 38 includes an opening 38*a* and a notch or groove 38*b* for receiving the connecting element 40 therethrough and for pivotally receiving an attachment end 40*b* of connecting element 40. Thus, connecting element 40 is retained to handle 38, and may move and flex with handle 38 as handle 38 is pivoted, so as to cause translational movement of arm 34.

As best shown in FIGS. 19-21A, arm 34 includes a tab receiving portion 34*c*, which defines an opening therethrough for receiving a desired or appropriate tab 24 therethrough when shelf 12 is positioned at and between side members 14. Similarly, arm 36 includes a tab receiving portion 36*b*, which defines an open ended slot for engaging and receiving a tab 24 therein when arm 36 is pivoted to engage the side members 14 via pivotal movement of handle 38. When the mounting assembly 22 is mounted to the shelf 12, such as to an underside of the shelf, the tab receiving portion 34*c* of arm 34 may protrude through an opening in a side wall or flange of the shelf (as shown in FIGS. 15, 16, 20A, 20B and 21A), while the tab receiving portion 36*b* is generally aligned with a corresponding opening in the side wall or flange of the shelf.

Figure 21B:
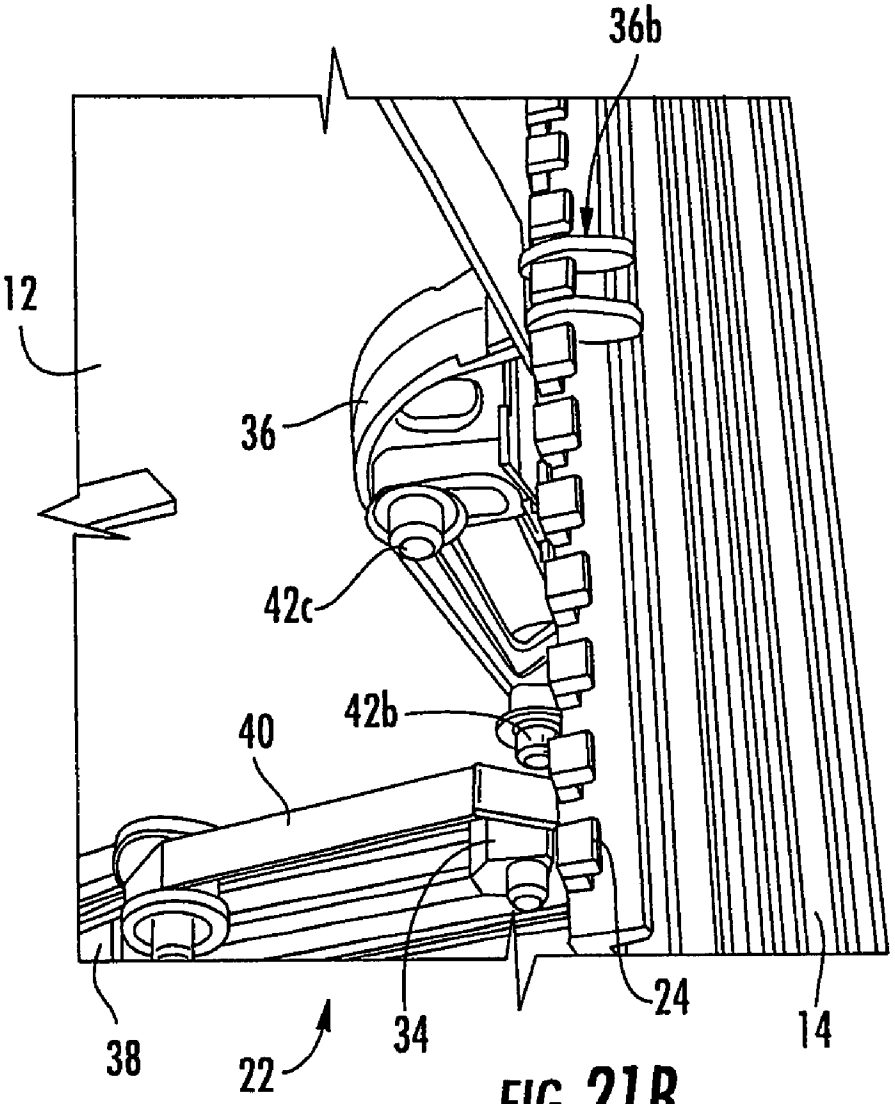
FIGS. 21A and 21B are perspective views of the mounting arms of the mounting assembly when secured to the forward and rearward edges of the side member.
Figure 21A:
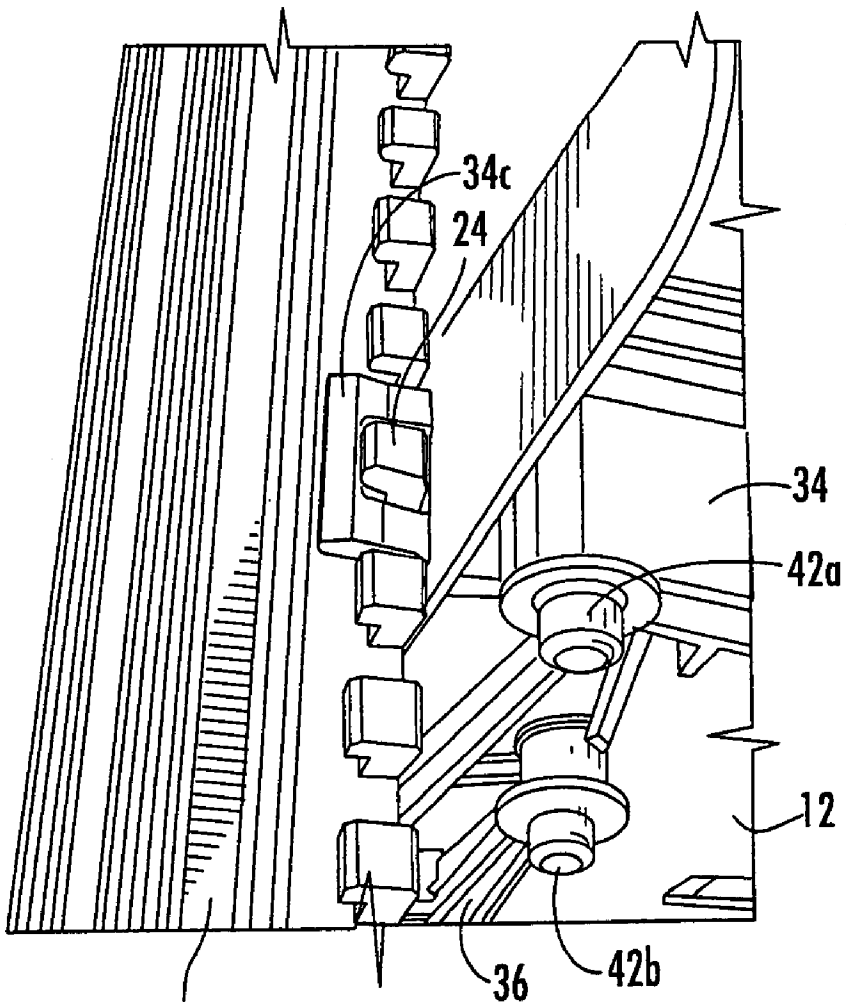

Thus, shelf 12 may be readily positioned at a desired height, and the arm 34 may be positioned so as to receive a protrusion or tab 24 at the forward edge 14*a* of side member 14 (as can be seen with reference to FIGS. 20A and 20B), while the arm 34 of the mounting assembly at the other side of the shelf is similarly positioned at its respective side member 14. Prior to locking or securing the shelf at the side members, the operator or installer of the shelf may check the markings along the side members to make sure that the shelf is level side to side and front to back. When the shelf is positioned at the desired location, the handles 38 of both mounting assemblies 22 may be pivoted (such as by pulling or pivoting the handles toward the center of the shelf) to pull arm 34 inward (away from the respective side member 14) to substantially clamp onto the tab 24 received through the tab receiving portion 34*c* of arm 34 (as can be seen with reference to FIG. 21A), and to pivot arm 36 to engage and receive a corresponding tab 24 at the rearward edge 14*b* of side member 14 within the tab receiving portion 36*c* of arm 36. When so secured, the tabs of the side members are nested into the apertures in arms 34 (FIG. 21A), while the claws of the arms 36 are engaged with a tab at that rearward side of the side members (FIG. 21B).

Although shown and described as having the forward arm 34 being slidably or longitudinally/translationally movably mounted to the shelf and with an aperture formed therethrough for receiving a protrusion at the forward facing edge of the side member, and the rearward arm 36 being pivotally mounted to the shelf with a slot for receiving the protrusion at the rearward facing edge of the side member, it is envisioned that the arms may be otherwise mounted to the shelf or otherwise configured to engage the protrusions at the forward and/or rearward facing edges of the side members, while remaining within the spirit and scope of the present invention. For example, the rearward arm may be slidably or translationally movably mounted at the shelf, while the forward arm may be pivotally mounted to the shelf, and the receiving portions of the arms (for receiving the respective side member protrusions) may be formed or established to clamp or engage the forward and/or rearward facing edges of the side members in a similar manner as described above.

Thus, forward arm 34 pulls the side member and shelf together while rearward arm 36 clamps the side member between the arms to limit or substantially preclude movement of the shelf relative to the side members. Preferably, the arm 38 or mounting assembly 22 may be substantially locked or retained in the engaged position, so as to substantially clamp the shelf to the side member 14 and to the protrusions protruding therefrom so as to substantially fixedly secure the shelf 12 to and between side members 14. The clamping action of the mounting assembly 22 functions to enhance the rigidity of the shelf and the side members and substantially fixedly attaches the shelf 12 to the side members 14 and limits or substantially precludes any relative movement therebetween. Because the side members include numbering or other indicia at their inner surfaces (the surfaces facing the shelf), the arms 34, 36 of the opposite mounting assemblies may be readily positioned at the same level or location along the shelf so that the shelf will be substantially horizontal when secured to the side members 14.

If it is desired to remove a shelf or change the position of the shelf (such as raise or lower the shelf along the side members), the handle assemblies may be actuated to readily release the shelf from the side members to allow for vertical movement of the shelf or removal of the shelf. For example, the handles may be pivoted (such as toward the outside of the shelf or toward the respective side member) to retract the claw or arm 36 from the tabs at the rear edge of the side members and to move the arm 34 outward to partially disengage the arm 34 from the respective tab at the forward edge of the side members. The shelf may then be readily moved forwardly to fully disengage the arms 34 from the tabs of the side members, whereby the shelf may be removed from the display assembly or moved vertically along the side members to a different desired or appropriate height along the side members.

When the shelves are secured to the side members at the desired or appropriate locations, the desired tray or trays or tray modules may be mounted to the upper surface of the shelves to provide the desired product support arrangement for the display assembly. For example, and as shown in FIGS. 22A-24, shelves 12 may support various trays or product supports or modules 20. For example, and with reference to FIG. 22A, a shelf 12 may support or receive a tray track or upper tray attachment portion 32 that is configured to movably or slidably or adjustably receive a tray module or tray thereon. The tray module, such as tray module 20 of FIG. 22B, may include a plurality of rows for supporting a row or column of products therealong. Each row may include a backstop or pusher element or paddle 20*a* that is movable along a support area 20*b*. Pusher element 20*a* may be spring loaded or biased toward a forward position (as shown in FIG. 22B), but may be moved or pressed rearwardly when product is placed on the support area 20*b* of the tray (as shown in FIGS. 22D-F), so that the product is biased toward the front of the tray, and thus the products are present at the front of the tray even as the products are removed from the tray.

Figure 22C:
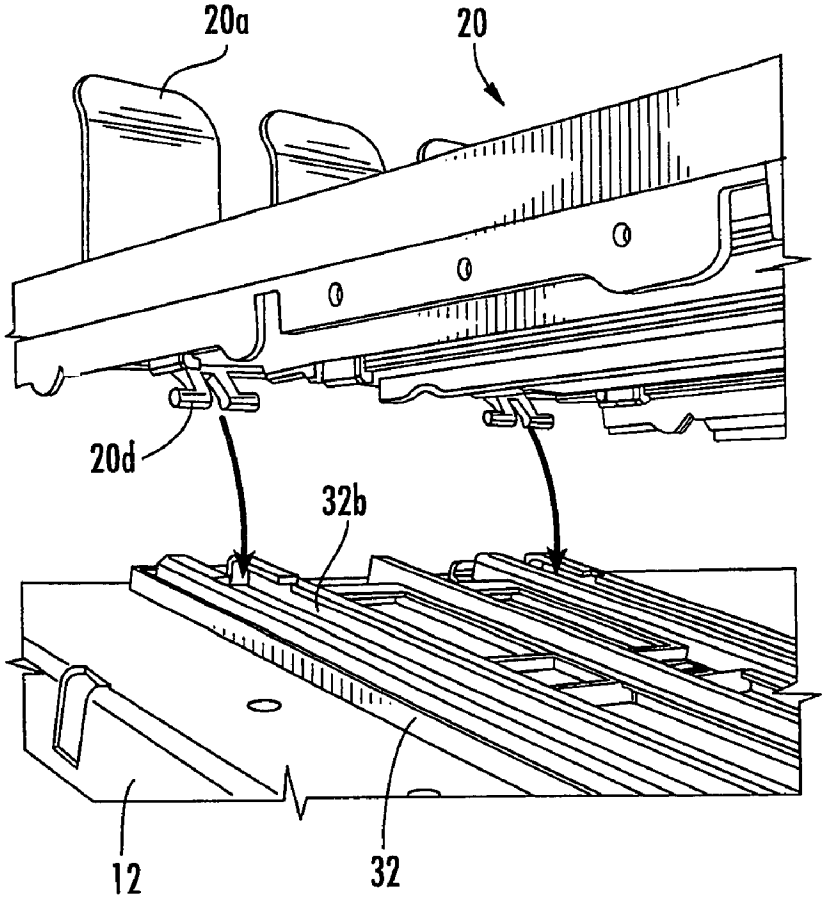
FIG. 22C is a perspective view showing the attachment of the tray module of FIG. 22B to the tray track of FIG. 22A.
Figure 22A:
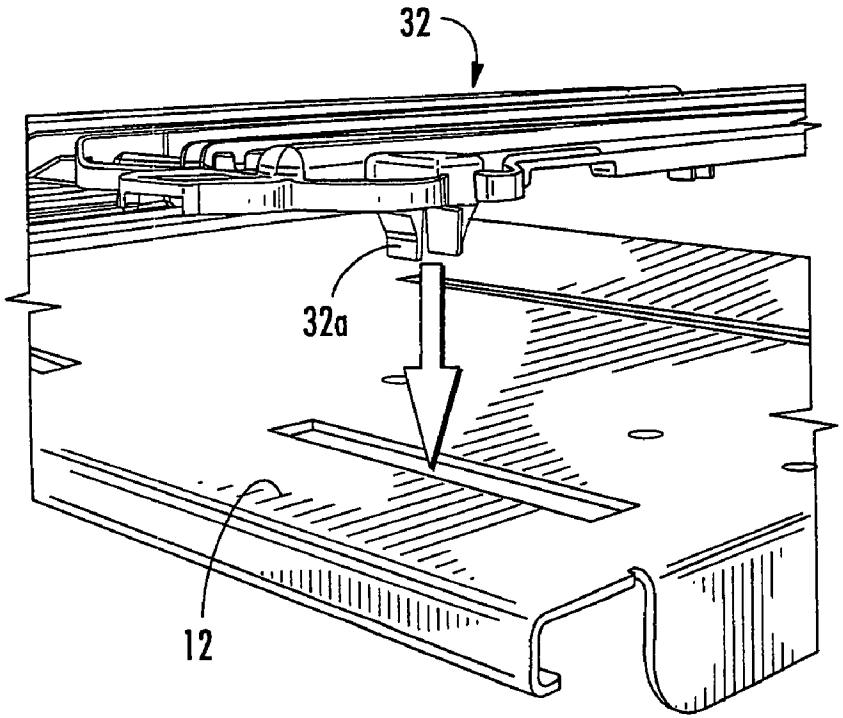
FIG. 22A is a perspective view of a tray track as it is being mounted to a shelf of the display assembly of the present invention.

As can be seen with reference to FIG. 22A, the track 32 may be attached or snapped to the shelf 12 (such as via a plurality of snaps or connectors 32*a* being inserted into or snapped into corresponding apertures or slots in the shelf 12). As can be seen with reference to FIG. 22C, the tray module 20 may be slidably mounted to track 32, such as via one or more sliding tabs or elements 20*d* of tray module 20 being inserted into one or more corresponding channels or slots 32*b* along track 32. The tray module may be pulled forwardly and pivoted relative to track 32 and shelf 12 (as shown in FIG. 22D), and then may be pivoted downwardly (as shown in FIG. 22E) to ease loading of product into or onto the tray module or modules. As shown in FIGS. 22D and 22E, two tray modules may be mounted together, such as a four product wide tray module 20 and a single product wide tray module 20', such as discussed below. The pusher elements 20*a* may be pushed rearwardly and retained or held at the rearward location (such as via locking to or engaging a tab or rib at the tray module) to ease loading of product into the tray modules. After the tray module is loaded with product, the pusher elements may be disengaged form the ribs or tabs of the tray module and slid forward against the loaded product. The tray module may be raised to a generally horizontal orientation and slid rearwardly onto the track 32 and shelf 12.

The product support trays may include or receive or attach to a label holder 20*c*, which defines a channel or receiving channel therealong. The label holder 20*c* may snap onto a forward edge of the tray module (such as via upper and lower lips or tabs of the label holder engaging/receiving corresponding lips or tabs of the tray module) to retain the label holder along the forward edge of the tray module. A label, such as a product label or price tag or the like, may be slid within the receiving channel to provide the appropriate label at the product trays. Optionally, other means for attaching such a label or label holder to the forward edge or portion of the tray module or modules may be implemented without affecting the scope of the present invention.

Figure 23C:
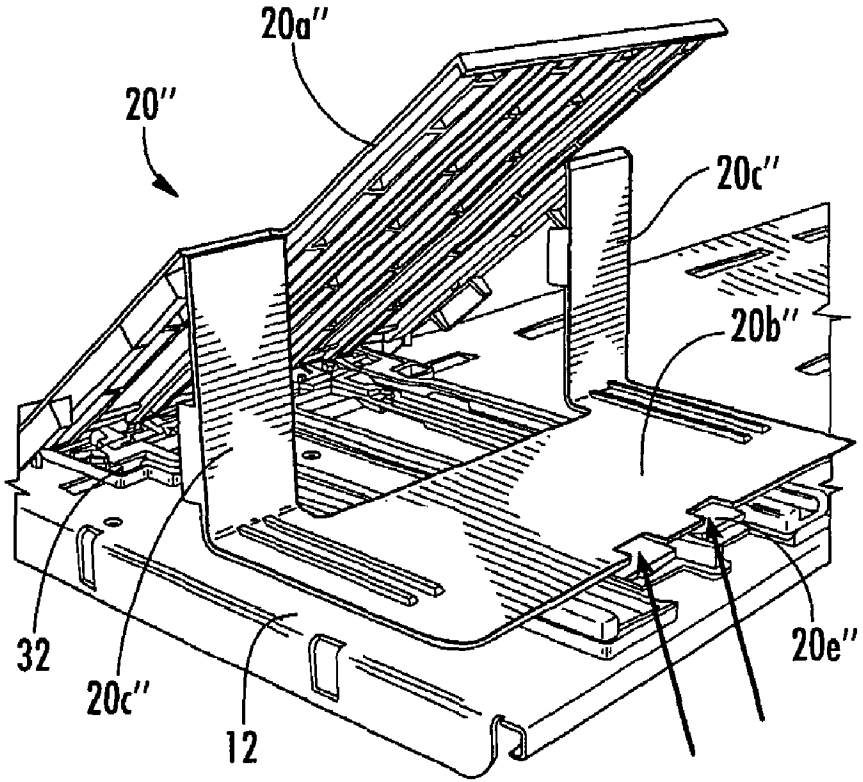
FIGS. 23B and 23C are perspective views of the tray module of FIG. 23A, with the tray module at an angled display orientation.
Figure 22B:
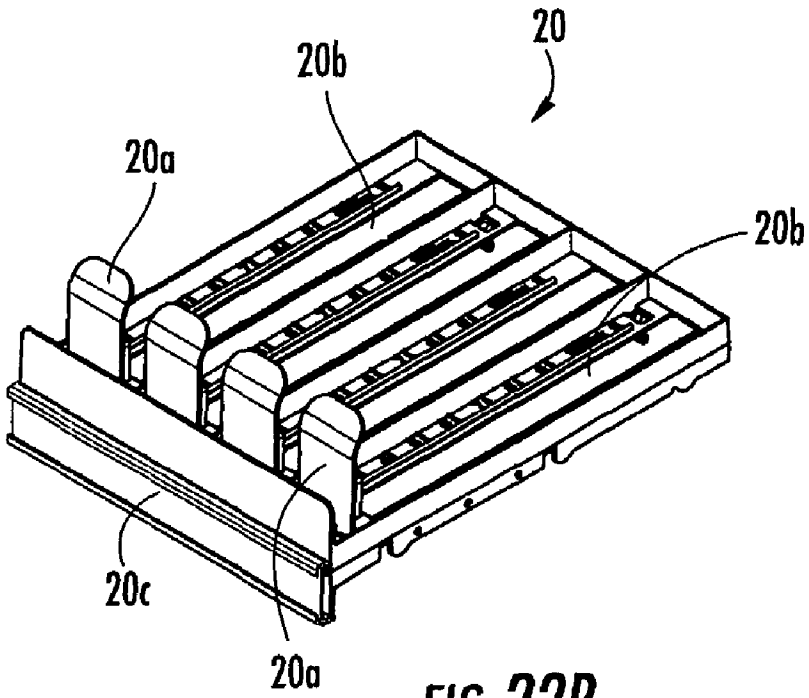
FIG. 22B is a perspective view of a tray module that is attachable to the tray track and shelf of the display assembly of the present invention.
Figure 22D:
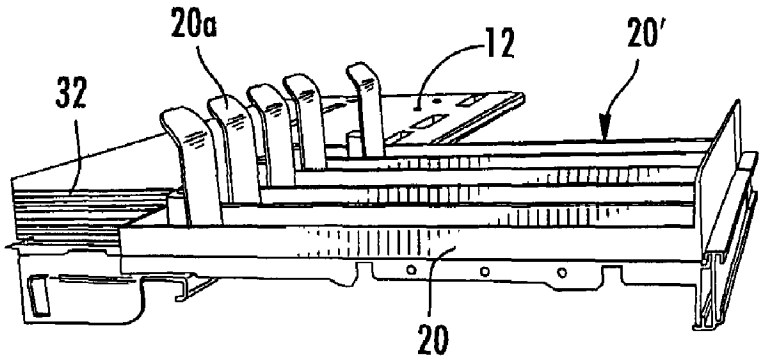
FIGS. 22D and 22E are perspective views of the tray module and tray track, with the tray module in an extended or loading position relative to the tray track.
Figure 22E:
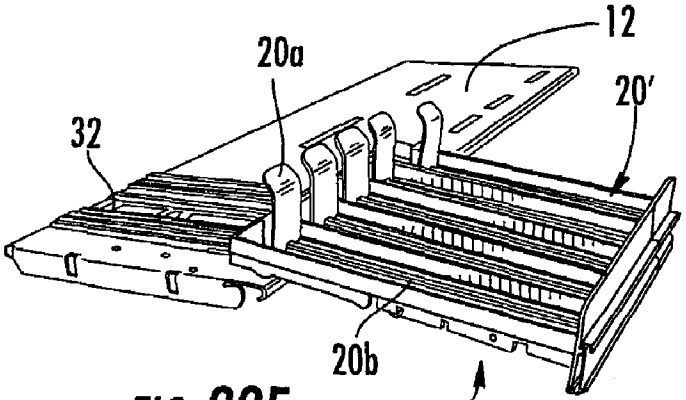
Figure 22F:
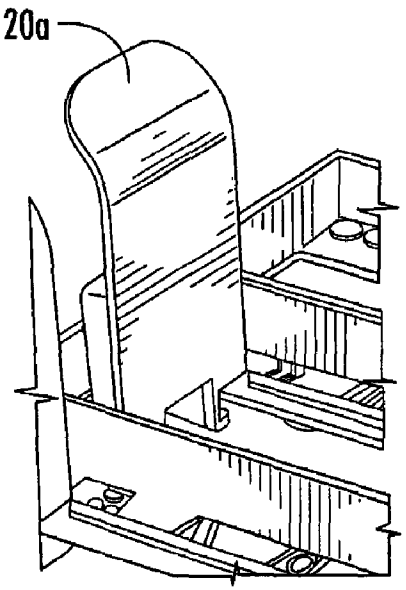
FIG. 22F is a perspective view of a portion of the tray module, showing the slidable paddle at a rearward position on the tray module.
Figure 23B:
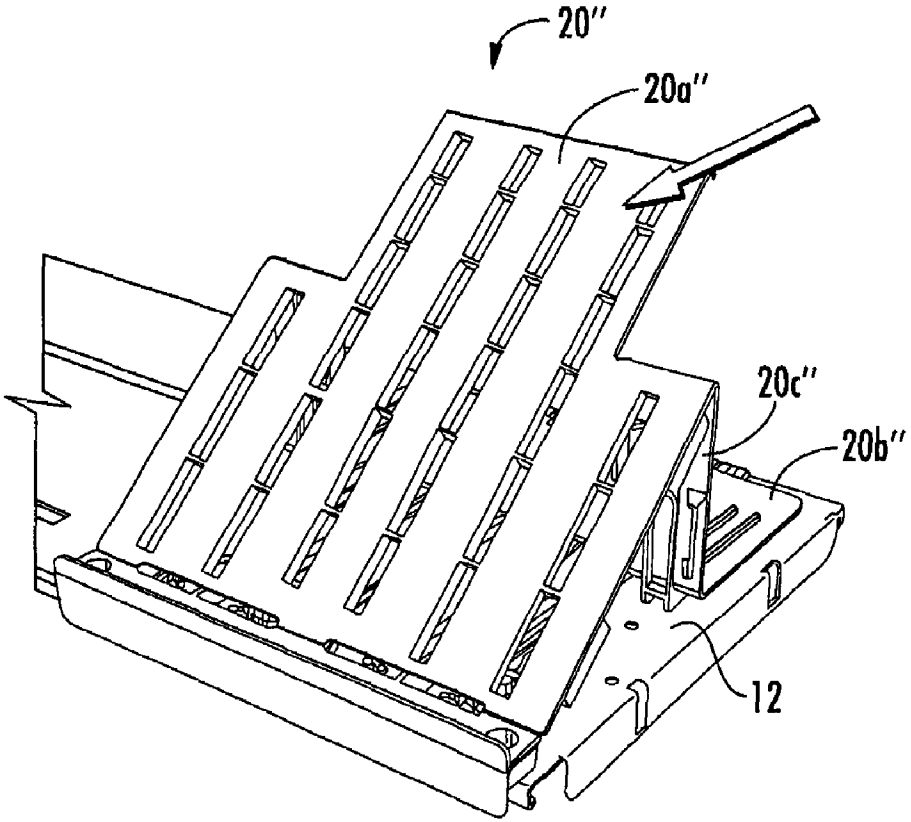
Figure 23A:
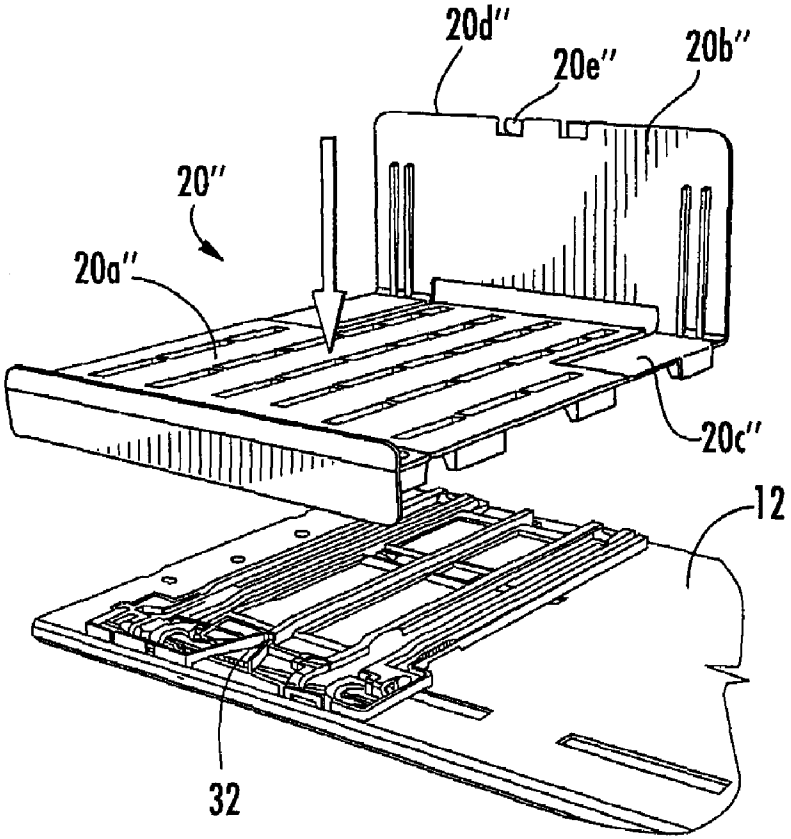
FIG. 23A is a perspective view of another tray module as it is mounted to the tray track of the display assembly of the present invention.
Figure 29A:
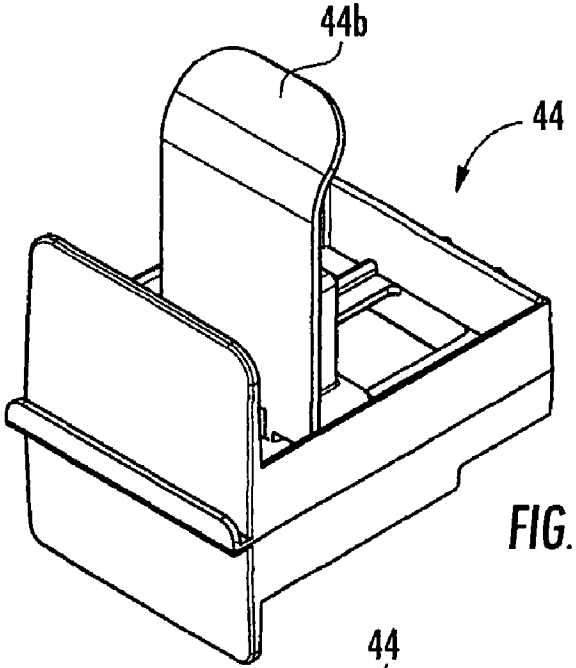
FIG. 29A is perspective view of a single product tray module for attaching to the side members of the display assembly of the present invention.
Figure 29B:
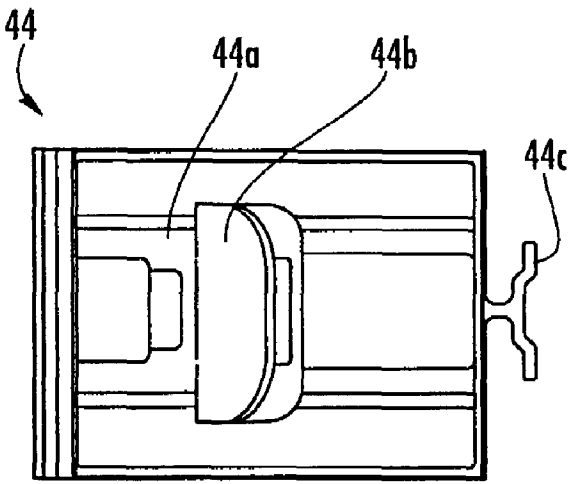
FIG. 29B is a top plan view of the tray module of FIG. 29A.
Figure 24:
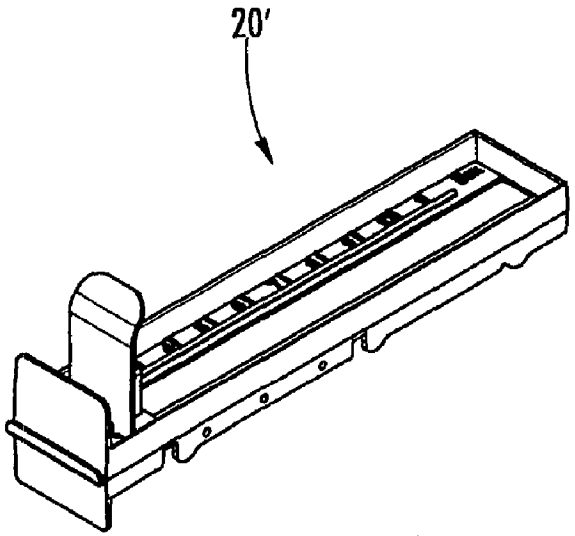
FIG. 24 is perspective view of another tray for use with the shelf of the present invention.

In the illustrated embodiment of FIG. 22B, the tray or tray module 20 has four support areas 20*b* for holding four rows of products thereon. However, the tray may hold more or less rows of products thereon without affecting the scope of the present invention. For example, and as shown in FIG. 24, a tray 20' may support a single line or row of products thereon in a similar manner as described above. Optionally, a tray or tray module 20" (FIGS. 23A-C) may be configured to hold large product items thereon, such as cartons of cigarettes and the like. Tray module 20" may be attached to the shelf track 32, such as by aligning module ribs or tabs with track channels of the shelf track 32. The tray module 20" may be readily attached and secured to the track 32, such as along a forward portion of the tray module 20". Optionally, and as shown in FIGS. 23B and 23C, the tray module 20" may be adjusted or tilted to provide an angled display surface. For example, the tray module may include a product support portion 20*a*" and a rear wall portion 20*b*" that extends generally vertically upward at the rear of the support portion 20*a*" when the support portion is in its horizontal orientation. When the front of tray module 20" locked or secured in place at the track 32, the support portion of the tray module may be angled or raised to convert the module to a "waterfall" display. When so angled, the rear wall 20*b*" is pivoted downward so as to generally lie on the track 32 to secure the wall 20*b*" relative to the track 32. In the illustrated embodiment, the rear wall 20*b*" extends at an angle (such as about 90 degrees) from a pair of support legs 20*c*", whereby the support legs 20*c*" may pivot relative to the support surface 20*a*" to move the rear wall 20*b*" from its generally vertical orientation (FIG. 23A) to its generally horizontal orientation (FIGS. 23B and 23C). Optionally, the upper edge 20*d*" of wall 20*b*" (or the rear edge when the wall is generally horizontal) of tray module 20" may include locking tabs 20*e*" for engaging corresponding locking elements at track 32 to secure the tray module in the inclined or angled orientation, as best shown in FIG. 23C.

Figure 26:
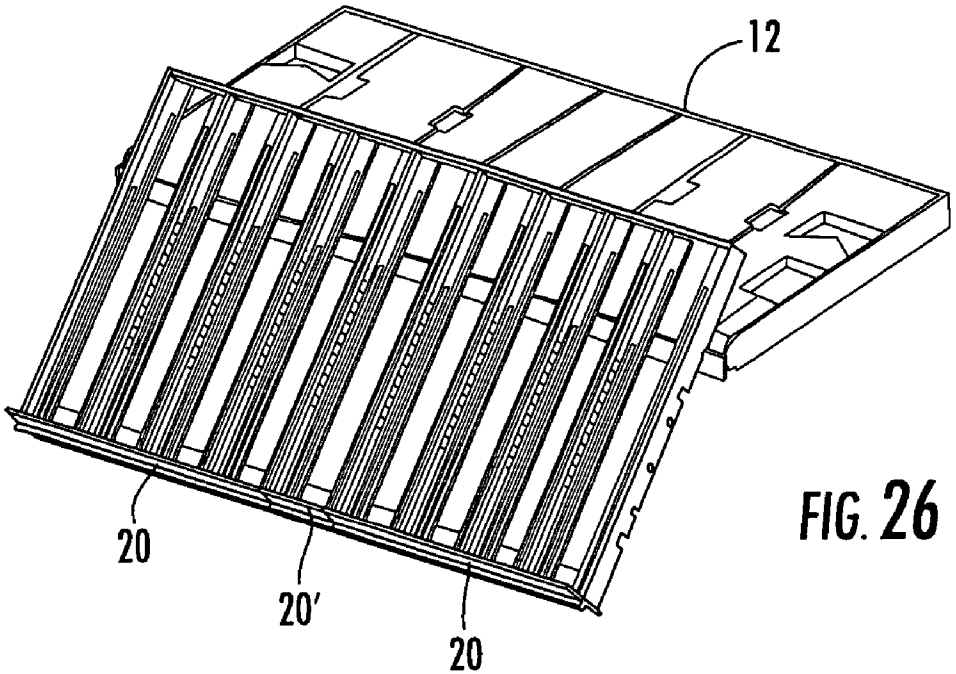
FIG. 26 is a perspective view of the tray and shelf of FIG. 25, with the trays moved forwardly and tilted downwardly relative to the shelf.
Figure 25:
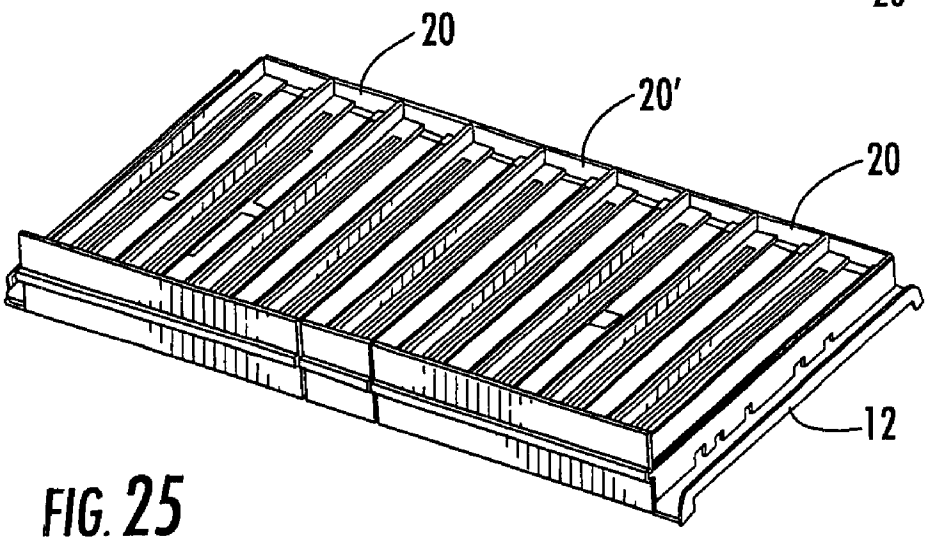
FIG. 25 is a perspective view of a tray and shelf of the present invention.
Figure 27A:
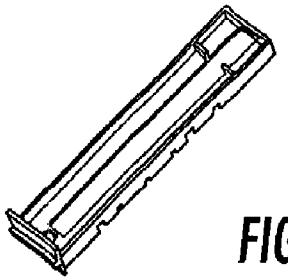
FIGS. 27A-E are perspective views of other trays suitable for use with the shelf of the present invention.
Figure 27B:
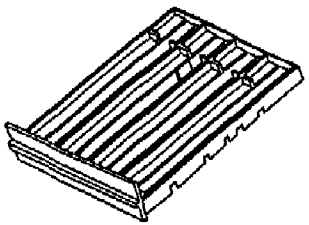
Figure 27C:
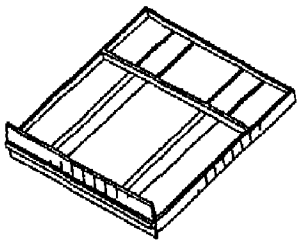
Figure 27D:
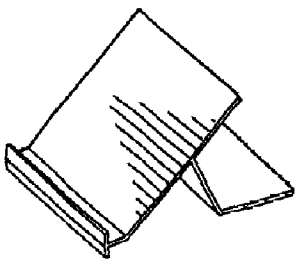
Figure 27E:
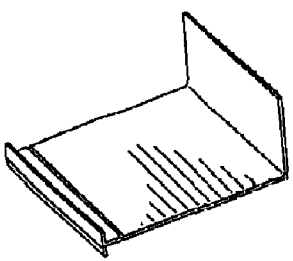

Optionally, and as shown in FIGS. 25 and 26, multiple trays or tray modules (such as trays 20 and 20' in the illustrated embodiment) may be movably attached to the shelf 12, and may be moved between a display position (FIG. 25) where the trays are positioned on the upper surface of the shelf 12, and a loading or unloading position (FIG. 26), where the trays are moved forwardly and pivoted downwardly relative to the shelf 12, in order to ease access of the trays for adding product thereto.

Figure 28B:
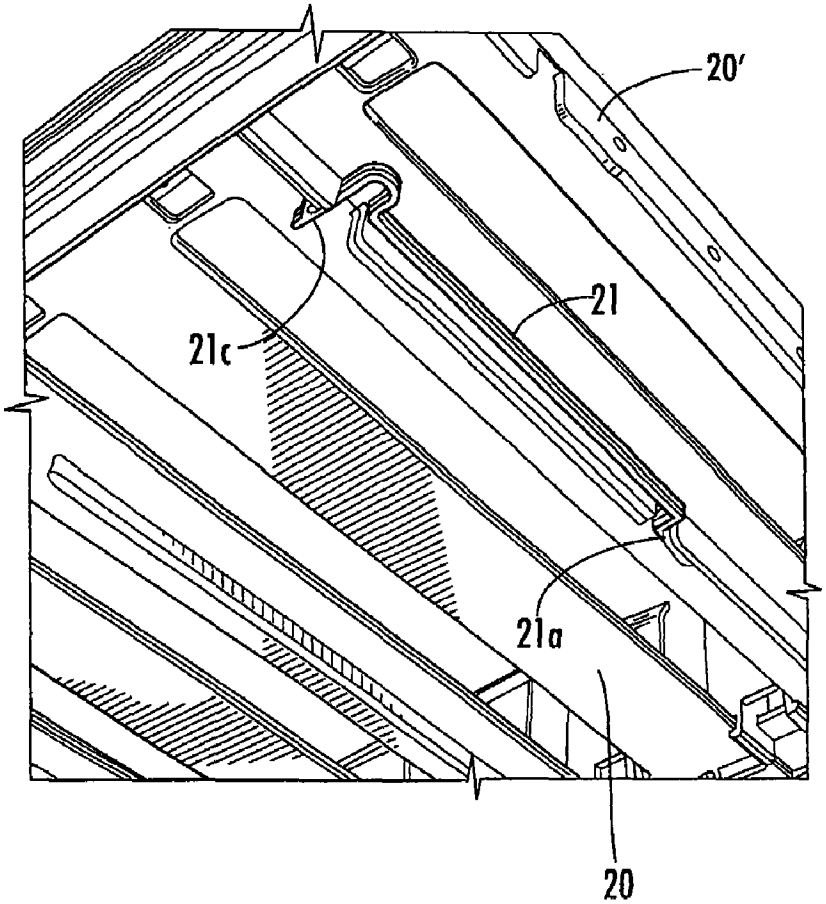
FIGS. 28A and 28B are perspective views of a connecting element for connecting adjacent tray modules to one another on a shelf.
Figure 28A:
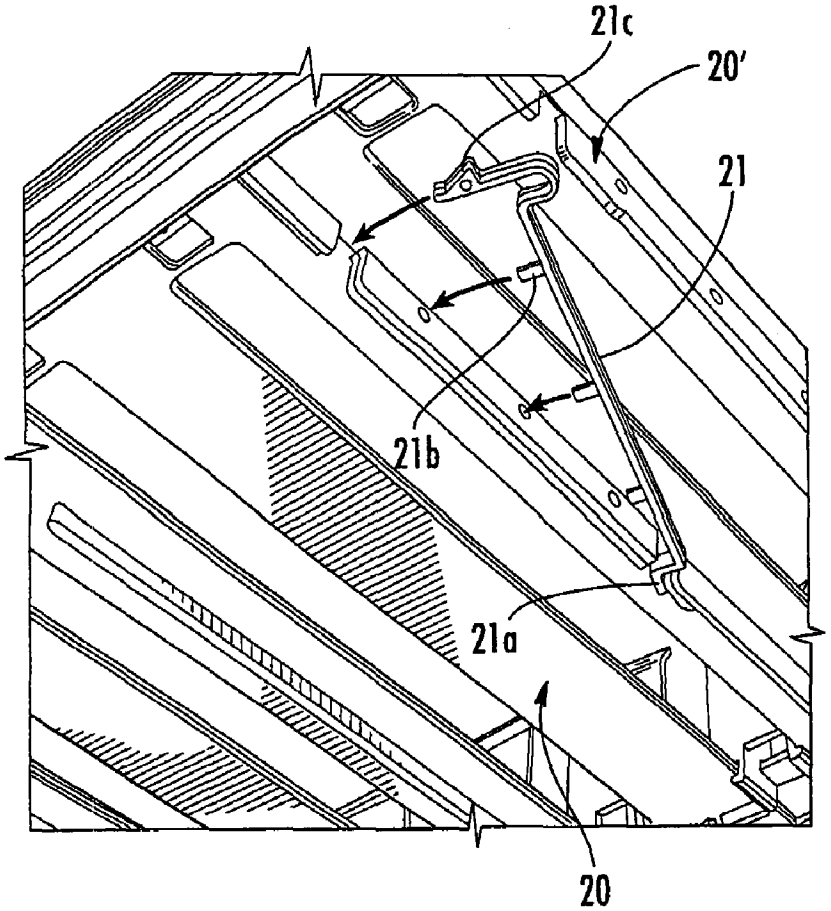

Optionally, and for applications where multiple trays are positioned on a single shelf, a tray connector or connecting element or clip 21 (FIGS. 28A and 28B) may be used to secure adjacent tray modules to one another, so that the tray modules may move between the display position and loading/unloading position in unison. For example, a tray connector 21 may hook through corresponding or aligned slots or notches through the adjacent side walls or edges of the tray modules (such as a four-wide tray module 20 and a single wide tray module 20') to substantially retain or secure the tray modules together on the tray shelf. In the illustrated embodiment, connecting clip 21 includes a flat end 21*a* for inserting into a slot, a plurality of posts 21*b* for inserting into aligned holes in the walls of the tray modules as the clip is pivoted or rotated toward an attaching/securing position, and a clip or snap end portion 21*c* that snaps into aligned slots of the opposed or adjacent walls to secure the tray modules relative to one another.

Other tray configurations may be implemented while remaining within the scope and spirit of the present invention. For example, trays such as those shown in FIGS. 27A-E may be used to display various sized products thereon. Thus, the trays may support individual products, such as individual boxes of cigarettes or the like, or the trays may support larger products, such as cartons of cigarette boxes or the like, without affecting the scope of the present invention.

In applications where two or more display modules (where each module includes a pair of opposite side members and a plurality of shelves mounted thereto in the manner described above) are positioned side-by-side, the adjacent or joined side members 14, 14' may nest together and may be secured together as discussed above. Shelves 12 may be positioned between respective side members of the respective modules, with the joined side members being positioned between the ends of adjacent shelves of the display modules. In order to substantially conceal the side members between the shelves (so as to provide the appearance of a substantially continuous shelf extending across the display cabinet assembly), the display assembly may include a plurality of product tray modules or side member edge covers 44.

As best shown in FIGS. 29-32, the product tray module 44 supports one or more product items, such as two cigarette packs or the like, on a product support arm 44*a*, and may include a back stop or pusher 44*b* that is biased toward a front end of the product tray module 44. Product tray module 44 mounts to the front edges 14*a* of the joined side members 14, 14', so as to substantially conceal the side members from view by a person viewing the front of the display cabinet assembly. For example, the tray module 44 may include a mounting tab or portion 44*c* (FIG. 29B) at its rear end portion (the portion or end facing the side members and opposite the portion or end that is viewed by a person viewing the front of the display assembly) that is configured to be received within a channel or groove 15 (FIG. 8A) at the forward edge 14*a*, 14*a*' of the side members to attach the tray module 44 to the side members. The mounting portion 44*c* may be frictionally received within the channel 15, and/or the tray module 44 may include other means for limiting vertical movement of the tray module along the side members 14, 14'. For example, the tray module 44 may include one or more tabs or protrusions for engaging the forward edge 14*a*, 14*a*' of one or both of the joined or adjacent side members 14, 14' to limit vertical movement of the tray module along the forward edges of the side members.

Figure 29D:
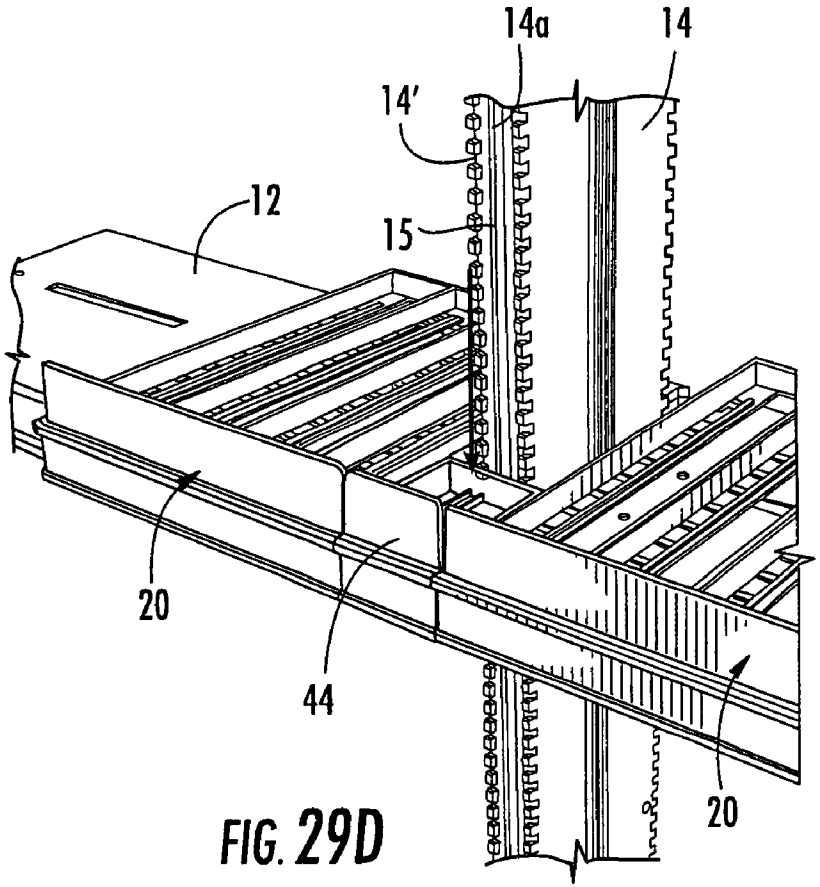
FIG. 29D is a perspective view of the single product tray module of FIG. 29C, shown attached to the side members.
Figure 29C:
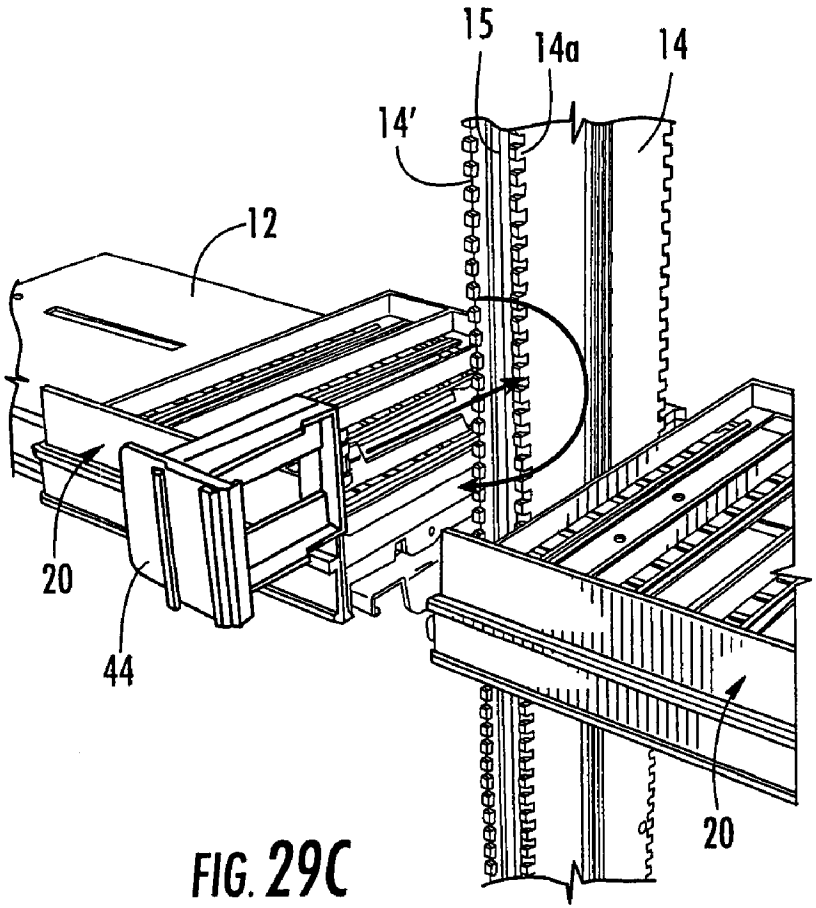
FIG. 29C is a perspective view of the single product tray module as it is being attached to the side members of the display assembly of the present invention.
Figure 30:
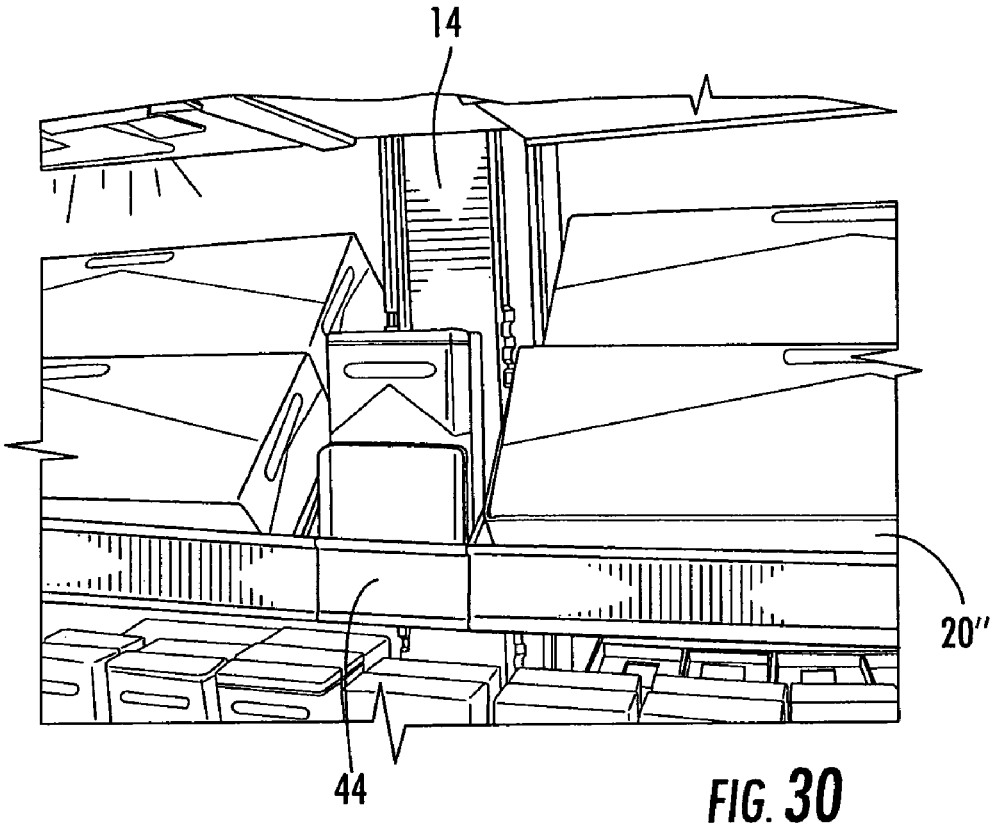
FIG. 30 is a perspective view of the display assembly of the present invention, shown with the product tray module attached to the front edges of the side members.
Figure 31:
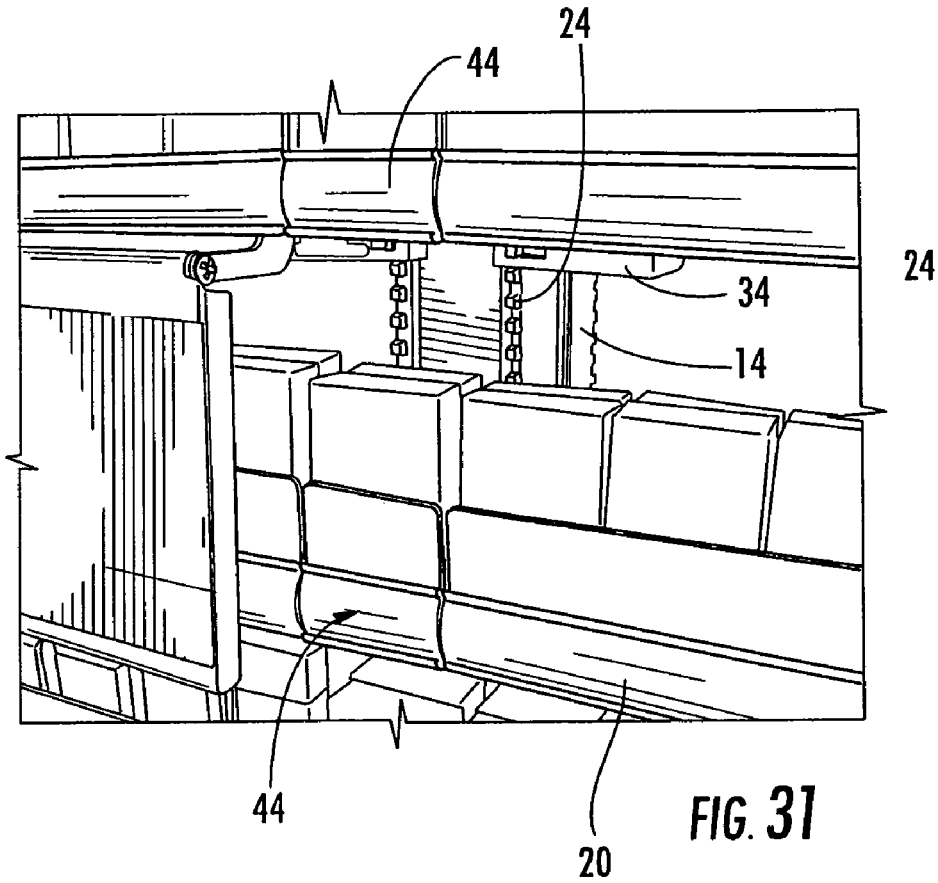
FIG. 31 is a another perspective view of the display assembly and product tray module of the present invention.
Figure 32:
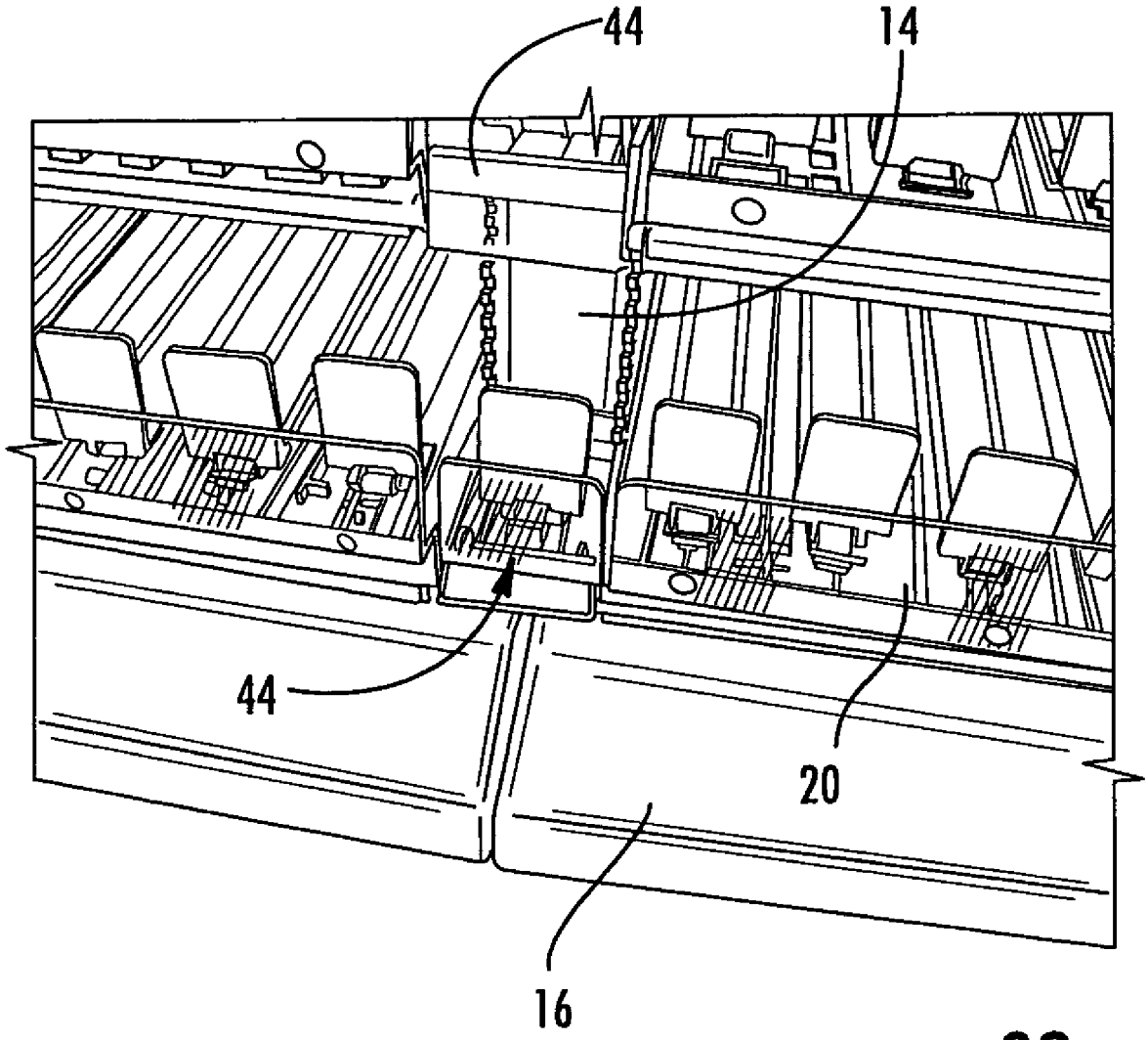
FIG. 32 is another perspective view of the display assembly and the product tray module.

Thus, the product tray module 44 may be readily attached at the forward edges 14*a* of the side members 14, 14' to substantially cover or conceal the side members at the junction of two adjacent display modules and between two aligned shelves of the adjacent display modules. For example, and with reference to FIGS. 29C and 29D, product tray module 44 may be rotated about 90 degrees (so as to be generally sideways) and inserted into the channel between the forward edges of the side members. The product tray module 44 may then be rotated or twisted to its upright orientation, whereby the tabs are snugly received and retained within the channel. The product tray module may be raised or lowered along the side members to the desired or appropriate location where the product tray module is substantially aligned with the adjacent and aligned shelves of the display assembly, such as shown in FIG. 29D.

As can be seen in FIGS. 29D and 30-32 the product tray module 44 may be readily attached to the forward edges of the adjacent side members at the same level as respective shelves of the two adjacent or adjoined modules 10*a*, so as to provide a substantially continuous "shelf" across the display cabinet assembly. Thus, the product tray modules allow the modular display assembly to be assembled and arranged in a desired manner, and facilitate substantially concealing the joined side members so a person viewing the display assembly views the assembly as a single or continuous unit and does not readily discern multiple modules of the modular display assembly. Optionally, however, it is envisioned that the side members may be left uncovered and visible between adjacent and aligned shelves, or any other form of cosmetic cover may be attached or snapped to the side members to substantially cover the side members where two display modules are joined together. Optionally, a cover element may also be provided over the forward edges of the side members between the shelves and product tray modules, so as to conceal the side members above and/or below the product tray modules.

Figure 33:
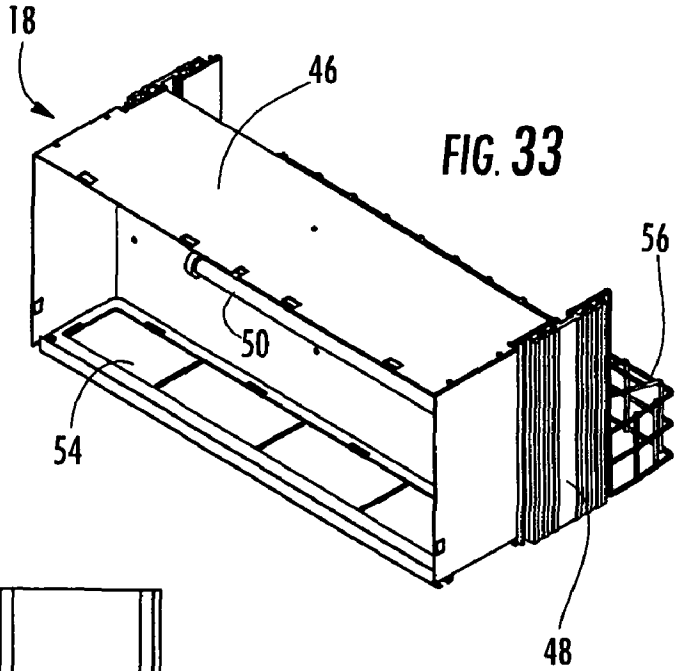
FIG. 33 is a perspective view of a header portion of the display assembly of the present invention.
Figure 34:
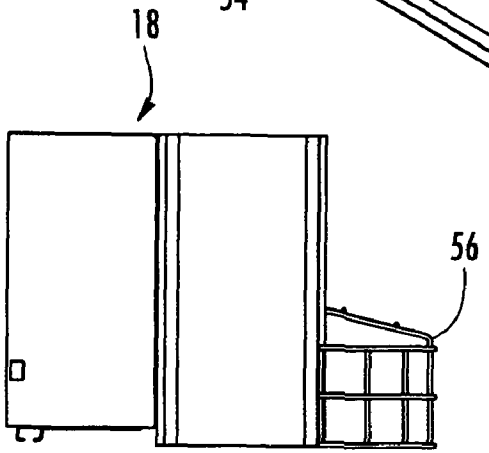
FIG. 34 is a side elevation of the header portion of FIG. 33.
Figure 35:
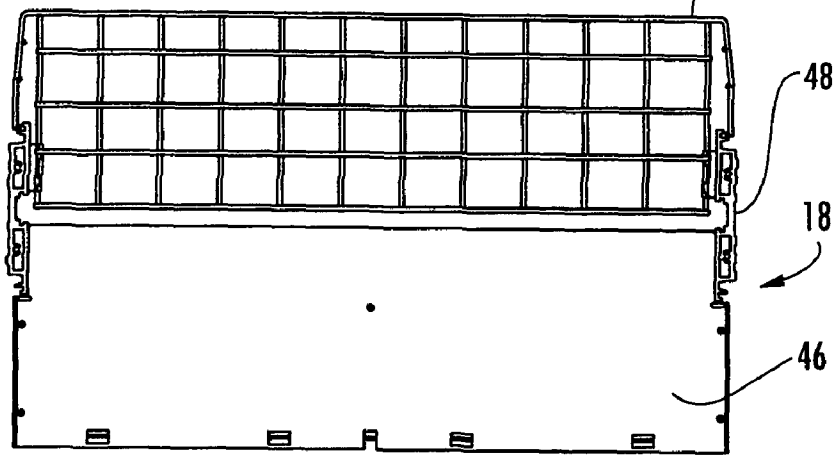
FIG. 35 is a top plan view of the header portion of FIGS. 33 and 34.
Figure 36:
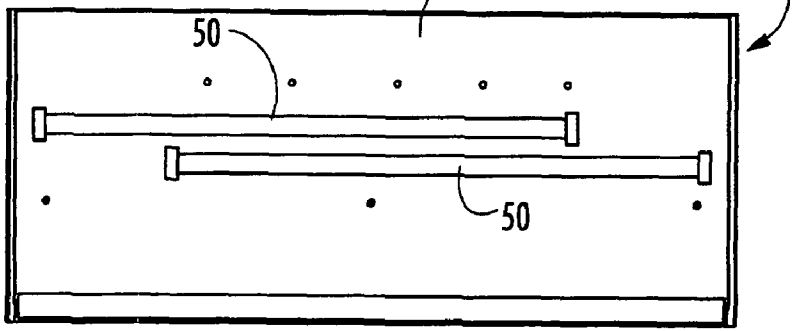
FIG. 36 is a front elevation of the header portion of FIGS. 33-35.

The display assembly 10, such as each display module 10*a*, 10*b*, 10*c* of the display assembly, may include a header portion 18 at an upper end thereof. As shown in FIGS. 33-36, header portion 18 may comprise a header box 46 attached to side member sections 48. The side member sections 48 may attach to the upper end of the side members or side members sections of the display module, such as via the bayonets or connecting elements 28 as described above. As can be seen in FIGS. 33 and 36, the header box 46 may house or receive one or more illumination sources 50, which may provide and project illumination through a display panel 52 (FIGS. 1 and 2), and through a transparent or translucent lower panel 54 to project illumination downward on the products of the display module.

Header portion 18 may also include a cage or retaining element 56 attached at its rearward side, and the entire display module may include a similar cage or retaining element 58 (FIGS. 3-5) attached along the entire rear edge portion of the side members (as shown in FIGS. 4 and 5). The retaining elements or cages substantially contain and secure the rear side of the display cabinet module, so that product items will not fall of the rear of the product trays.

The header portion or portions support or mount a display panel, such as a backlit, substantially translucent display panel 52, such as those shown in FIGS. 1, 2A and 2B. The size of the display panels for the display cabinet assembly may be selected irrespective of the size of the individual display modules, so that one or more display panels may be provided at or mounted to the header portion or portions at the upper end of the display cabinet assembly. For example, a curved display panel 52 may be selected for a center portion of the display assembly, and one or more flat display panels 53 (FIGS. 2A and 2B) may be selected for one or more side portions of the display assembly. The header portions of the display assembly are configured to receive or support the display panels at any desired or appropriate location along the header portions and optionally with part of the display panel supported by or attached to one header portion and another part of the display panel supported by or attached to another header portion. The display assembly of the present invention thus allows header bezel sizes or display panel sizes to be different that the size or width of the individual modules or units, and thus provides enhanced flexibility to the display assembly. Thus, different combinations of different header faces or display panels may be used in conjunction with different length frame units or header portions. The customer thus is not locked into using a four foot wide header graphic element or display panel on a four foot wide unit, but may instead use, for example, a two foot wide curved display panel and two, one foot wide flat display panels (or compartments or shelves) at the opposite sides of the display panel, if that is the appearance that is desired. The bezels or display panels may be positioned along the header portions and clipped or snapped or otherwise attached to the header portions, and optionally (and desirably) to the adjacent bezel or display panel to ensure a substantially continuous display panel or bezel across the header portion or portions of the display assembly.

Figure 37A:
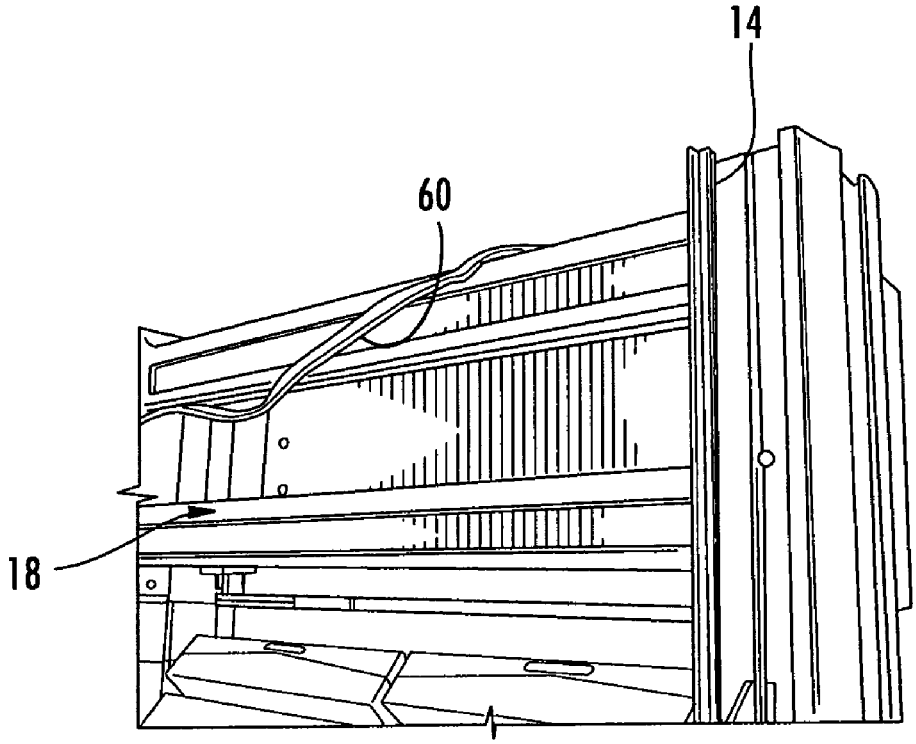
FIGS. 37A and 37B are rear perspective views of a header portion of the display assembly of the present invention.
Figure 37B:
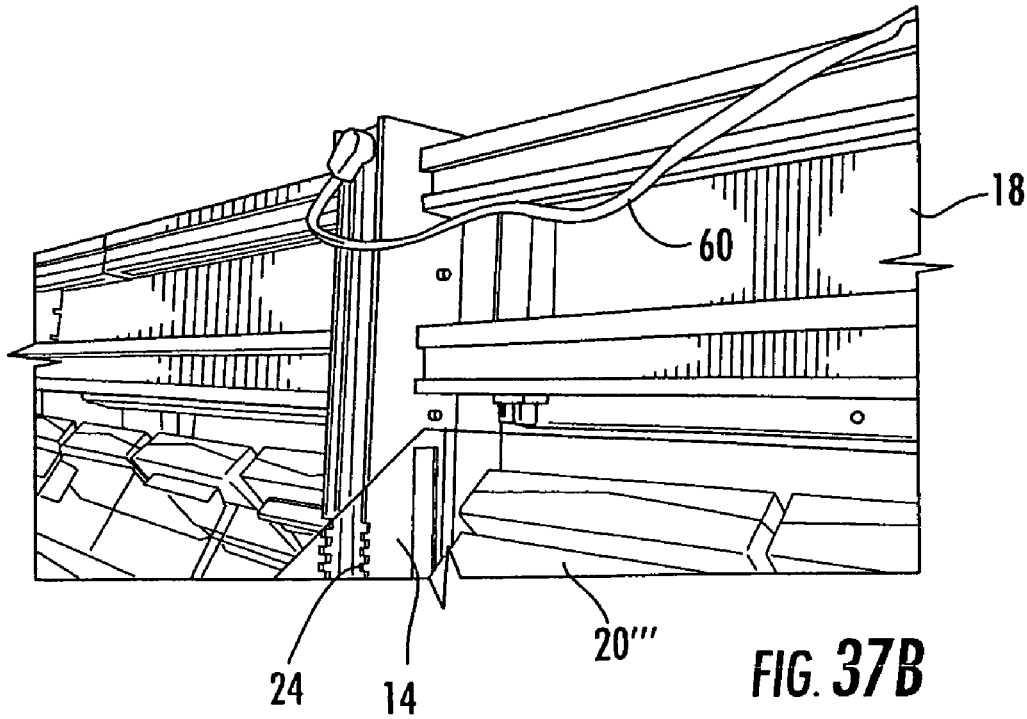

As shown in FIGS. 37A and 37B, the header portion 18, and the illumination sources 50 included therein, may be electrically connected to a power source. The header portion 18 may comprise an electrical power cord 60, which may plug into an outlet at one of the side member sections, such as at the upper portion of the side members of the header portion 18. The side members and side member section preferably include an electrical wire channel extending therealong so as to provide a passageway for an electrical wire to be routed along the side members, such as from an upper end portion (where the header portion may be connected thereto) to a lower portion (where a cord or plug may extend therefrom for electrical connection to a power source). Optionally, one or more electrical outputs may be provided along the inner surface of the sidewalls or side members or side member sections, so that an illumination source or other electrical device may be plugged into the socket to connect to the power supply, so that illumination or other features (such as an audio recording or the like) may be provided at the display unit.

Figure 37C:
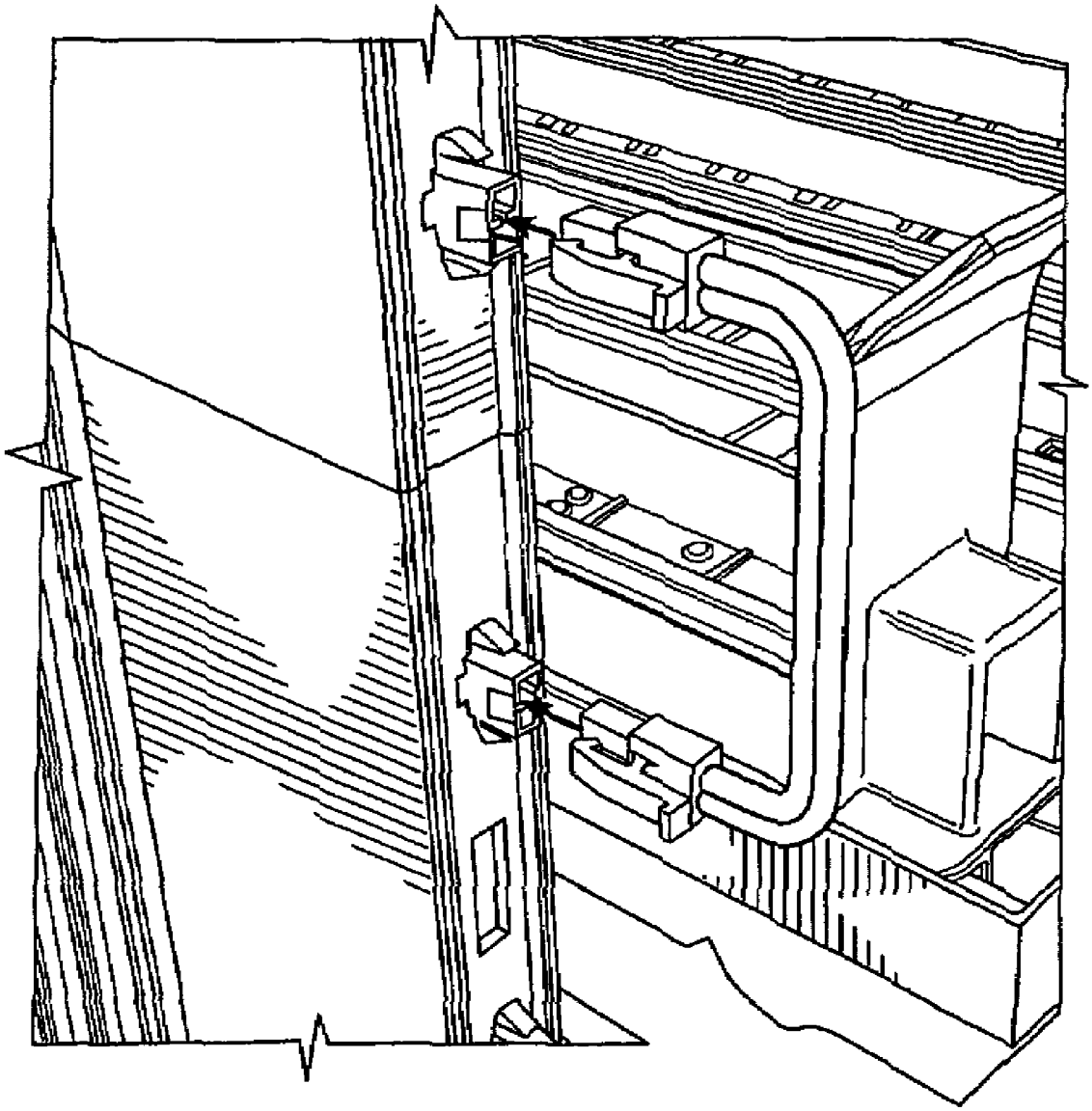
FIG. 37C is a perspective view of the side members of the display assembly, showing an electrical jumper cable that electrically connects adjacent side members.

Optionally, and as shown in FIG. 37C, an electrical cable or element or connector of the side members may be electrically connected to an electrical cable or element or connector of another side member (above or below the first side member) via a jumper cable or wire or connector 61. When the side members are connected together (such as via the connectors or bayonets 28), the jumper wire 61 may be readily plugged into corresponding sockets or receptacles 62 established or disposed at the side of the side members so as to provide an electrical connection between the side members of the display assembly.

Thus, the display cabinet assembly of the present invention may be readily configured to a desired height and/or width via assembly of the side members and header portions. If it is desired to adjust or modify the display assembly at a later date, the header portion may be readily removed from the upper ends of the side members and sections of side members may be removed (if it is desired to shorten the display assembly) or sections of side members may be added (if it is desired to heighten the display assembly). The bayonets and side members facilitate assembly and disassembly of the display assembly with minimal fasteners and tools required. Further, the shelves may be readily removed, adjusted and reinstalled via the mounting assemblies at the underside of the shelves. When the display cabinet assembly is assembled or reassembled, the electrical connections between the joined and adjacent side members may be readily made via a jumper wire (or may be made via an electrical connection that may be made at the ends of the side members as they are joined together). The display cabinet assembly of the present invention thus is a flexible or adjustable display cabinet assembly that may be modified and/or assembled to a variety of dimensions with a variety of different shelving configurations and display configurations and the like available for selection by the customer or purchaser of the display cabinet assembly.

Figure 38:
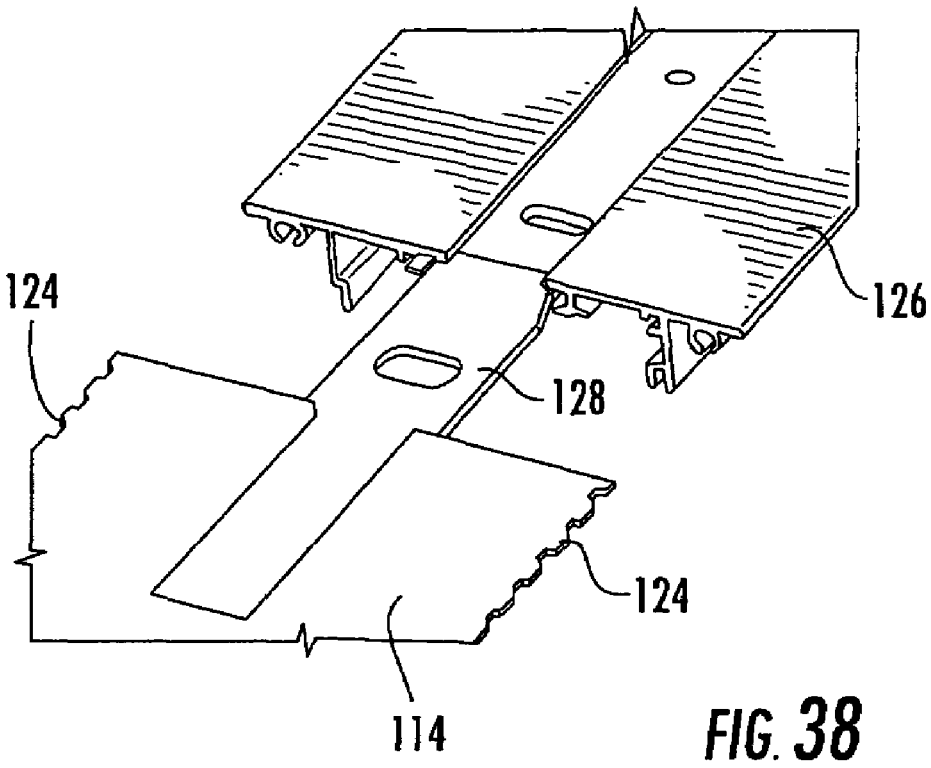
FIG. 38 is a perspective view of another side member and connecting element for connecting to side member sections together in accordance with the present invention.
Figure 39:
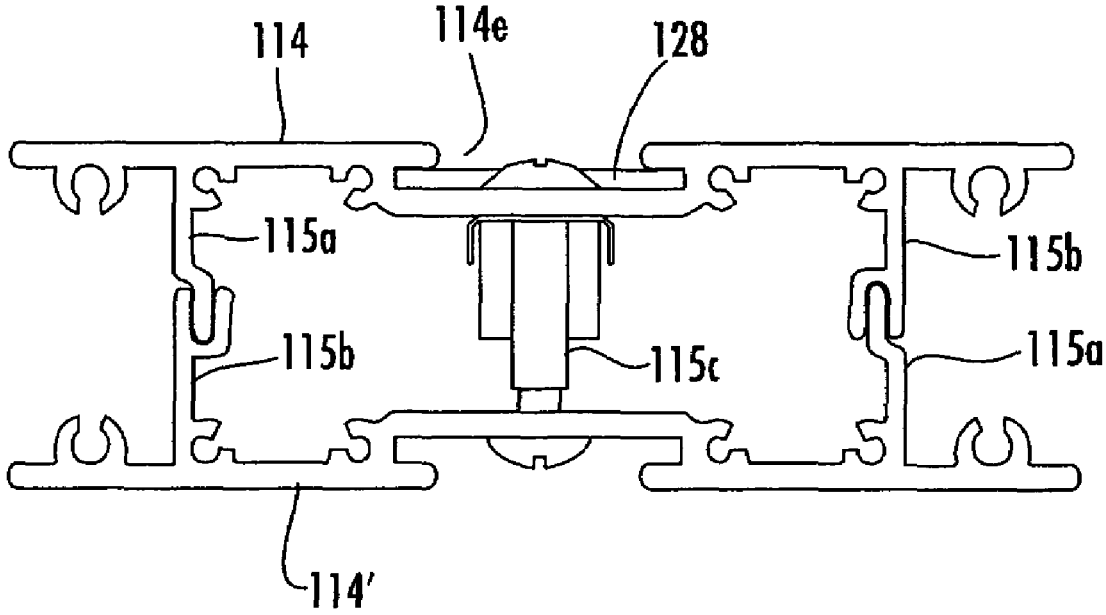
FIG. 39 is an end elevation of a side member assembly having two side members of the type shown in FIG. 38 secured together in accordance with the present invention.

Optionally, the side members of the display assembly of the present invention may be otherwise formed while remaining within the scope and spirit of the present invention. For example, and as shown in FIGS. 38 and 39, a side member 114 may be formed with the tabs or protrusions 124 extending from the forward and rearward edges in a similar manner as described above. The side member 114 may be formed with a single channel 114*e* for receiving a single bayonet or connecting element 128 therein to substantially connect a lower side member 114 with an upper side member 126 (FIG. 38), such as in a similar manner as described above. As shown in FIG. 39, the side members 114 include connecting elements 115*a*, 115*b* extending therefrom for connecting to an adjacent side member 114' of an adjacent or adjoining display module. The side members 114, 114' are common parts, so that when arranged with their outer walls or surfaces facing one another (such as when two adjacent display modules are joined together), connecting elements 115*a*, 115*b* may correspondingly engage and/or receive one another to align the side members, whereby a fastener 115*c*, such as a screw or bolt or the like, may be implemented to retain the side members 114, 114' and the display modules together.

Figure 40:
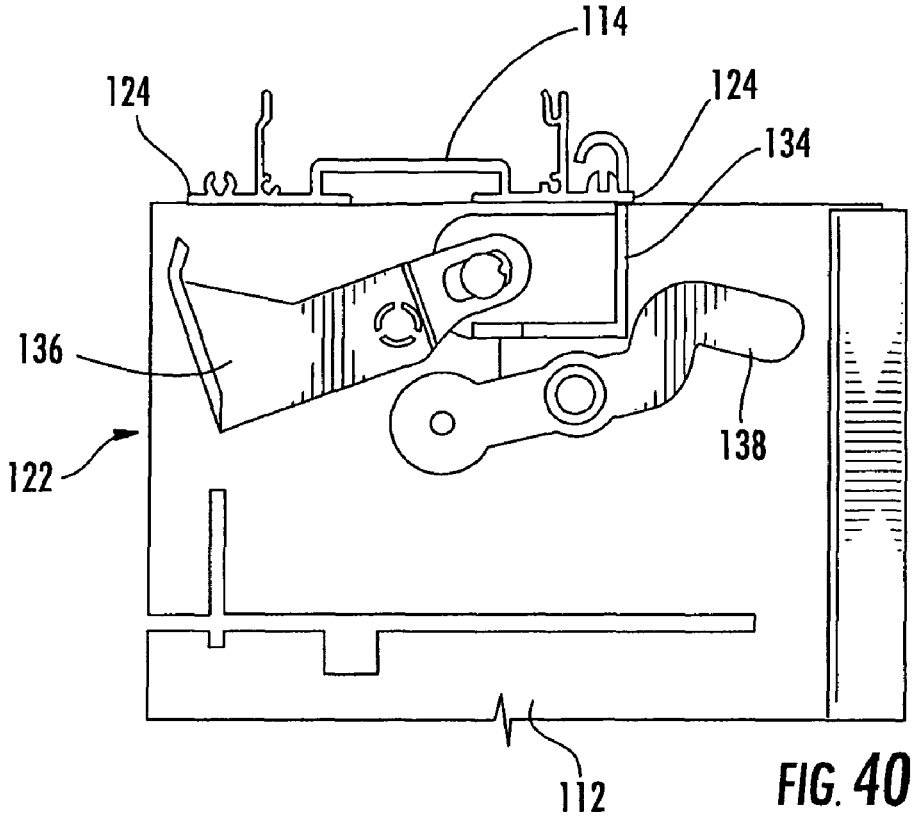
FIG. 40 is a plan view of another mounting assembly for mounting a shelf to the side members in accordance with the present invention.
Figure 41:
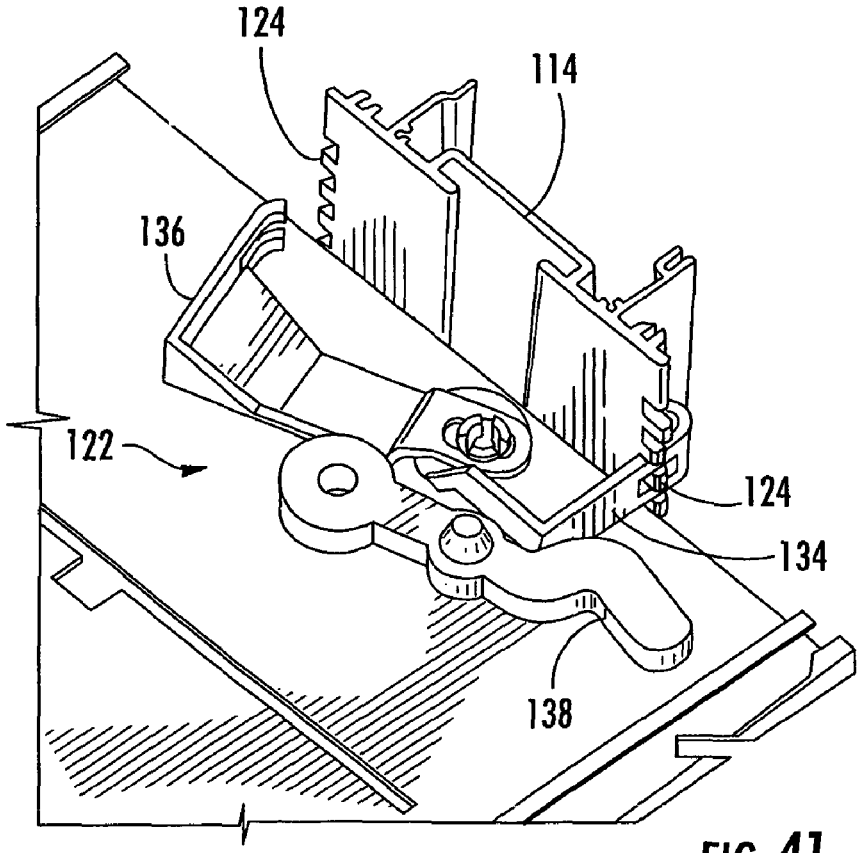
FIG. 41 is perspective view of the mounting assembly of FIG. 40.
Figure 42:
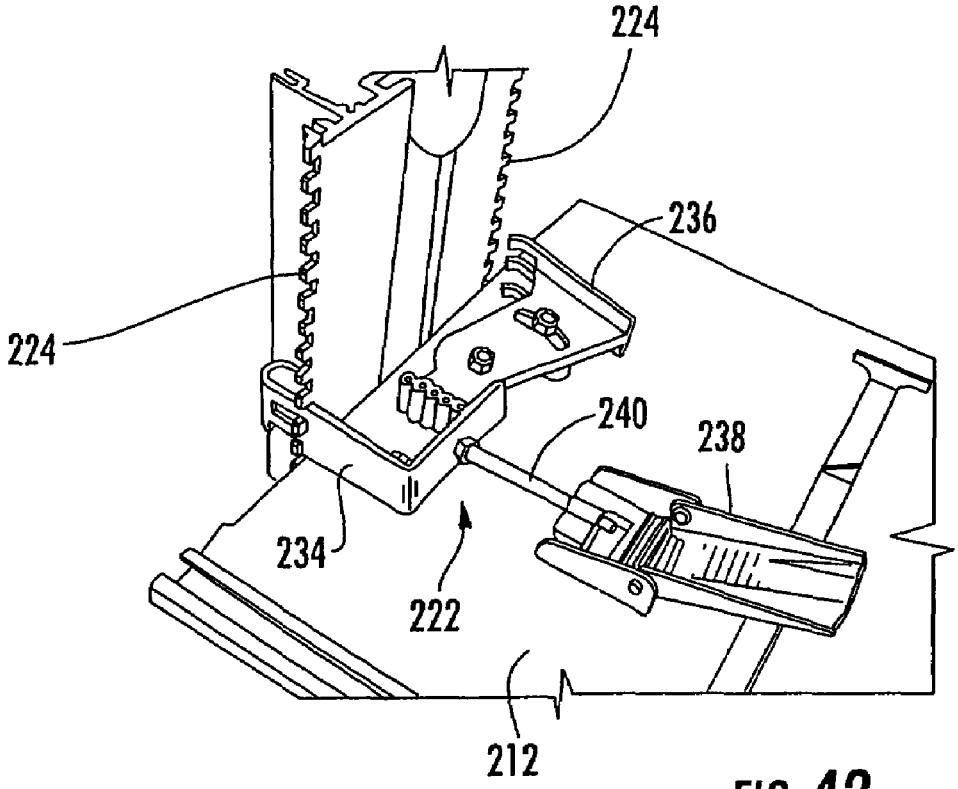
FIGS. 42 and 43 are perspective views of another mounting assembly for mounting a shelf to the side members in accordance with the present invention.
Figure 43:
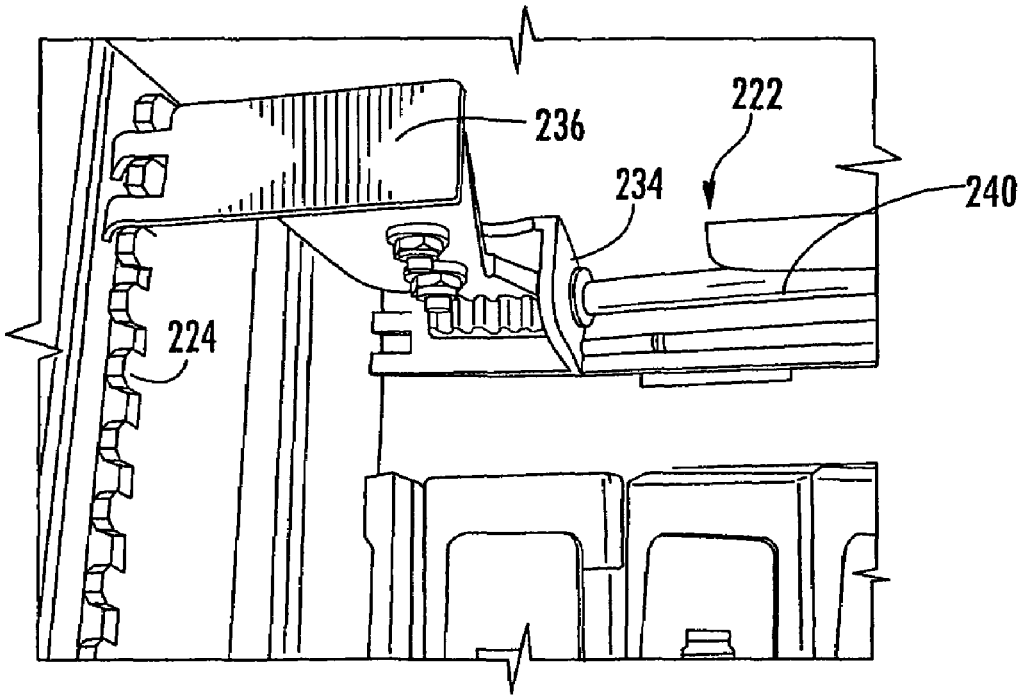
Figure 44:
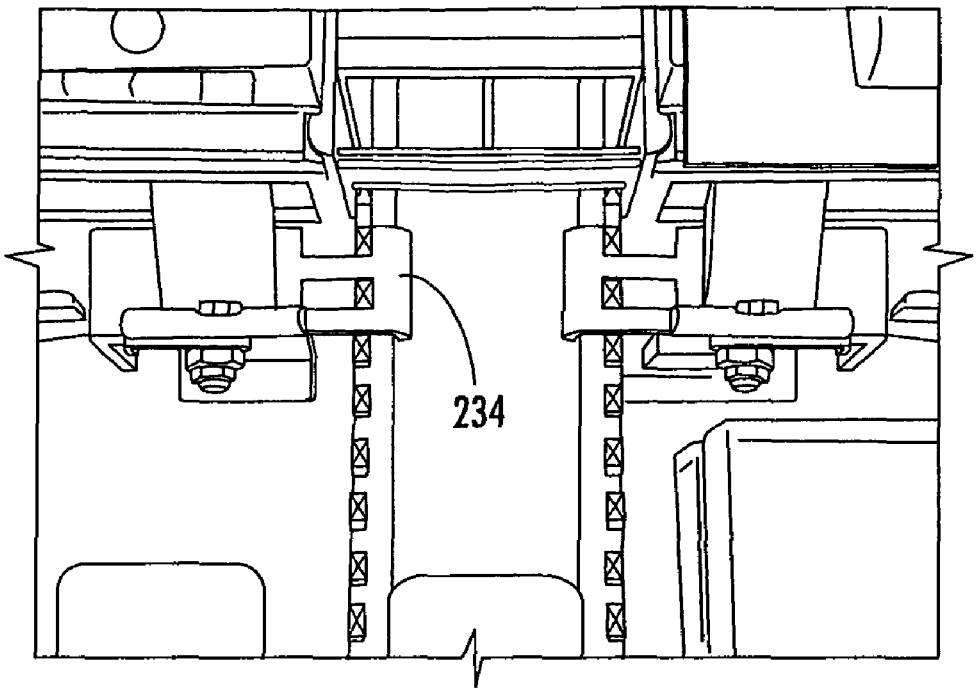
FIG. 44 is a front elevation of a display assembly showing the mounting assembly securing to the front edges of the side members in accordance with the present invention.
Figure 45:
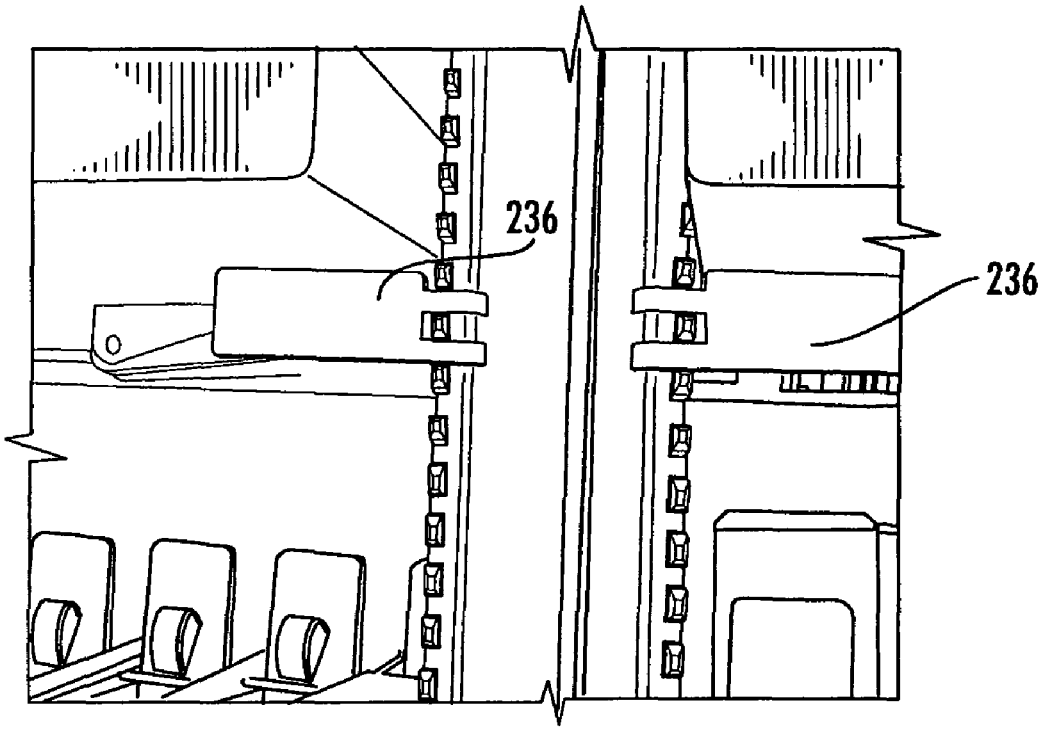
FIG. 45 is a rear elevation of the display assembly showing the other portion of the mounting assembly engaging the rear edges of the side members to secure the shelf to the side members in accordance with the present invention.

Optionally, the mounting assemblies of the shelves may be otherwise arranged or configured in a different manner than described above, while remaining within the spirit and scope of the present invention. For example, and with reference to FIGS. 40 and 41, a mounting assembly 122 includes a first engaging arm 134 and a second engaging arm 136 for engaging the respective protrusions 124 of the side member 114. The engaging arms 134, 136 are moved into engagement with the protrusions 124 via manual movement of a handle portion 138, which is pivotally mounted to the shelf 112 and pivotally connected to the engaging arm 134. Arm 134 is slidably or movably attached to the lower surface of shelf 112 and is translationally movable inward and outward at the side of the shelf via pivotal movement of handle 138. The other arm 136 is pivotally mounted to the lower surface of the shelf 112 and is pivotally connected to arm 134. Thus, pivotal movement of the handle 138 imparts a translational movement to the arm 134, which imparts a pivotal movement to the arm 136 to engage the tabs 124 of the side member and to clamp the arms to the side member in a similar manner as described above.

Optionally, and with reference to FIGS. 42-45, a mounting assembly 222 includes a first engaging arm 234 and a second engaging arm 236 for engaging the respective protrusions 224 of the side member 214. The engaging arms 234, 236 are moved into engagement with the protrusions 224 via manual movement of a handle portion 238, which is pivotally or movably mounted to the shelf 212 and connected to the engaging arm 234 via a connecting element 240. Arm 234 is slidably or movably attached to the lower surface of shelf 212 and is translationally movable inward and outward at the side of the shelf via pivotal movement of handle 238. The other arm 236 is pivotally mounted to the lower surface of the shelf 212 and is connected to arm 234. Thus, pivotal movement of the handle 238 imparts a translational movement to the arm 234, which imparts a pivotal movement to the arm 236 to engage the tabs 224 of the side member and to clamp the arms to the side member in a similar manner as described above. The handle is moved by flipping a handle portion, which pulls at the connecting element 240 and arm 234, and which substantially locks the arms 234, 236 in the engaged or clamped positions.

Therefore, the present invention provides a modular display assembly that facilitates easy installation and adjustment of shelves along and between the side walls or side members of the display assembly. The shelves are mounted to the side walls via a mounting assembly that substantially clamps the side walls to substantially fixedly retain the shelf to the side walls at the desired height or location. The clamping of the side walls by the mounting assembly provides enhanced structural rigidity to the display module or assembly and the mounting assembly is readily adjustable or disengagable to move the display shelves to different locations along the side walls. Two or more display modules may be positioned adjacent to one another and may be readily adjoined to form a unitary display assembly. The side walls may be substantially covered or concealed between corresponding shelves of the adjacent display modules via one or more product trays that attach to a forward edge of the joined side walls and support one or more products or items thereon, such that the shelves of the display assembly appear to continuously extend across both display modules.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A display assembly for displaying merchandise, said display assembly comprising:

a pair of opposite side members, each of said side members having a forward facing edge and a rearward facing edge, at least one of said forward and rearward facing edges comprising a plurality of protrusions spaced therealong;

at least one shelf adjustably mounted to said side members;

said shelf including a mounting assembly at least one end thereof, said mounting assembly comprising a handle and first and second arms for engaging said forward and rearward facing edges, respectively, of a respective one of said side members to mount said shelf to said side members, wherein at least one of said arms is configured to engage at least one of said protrusions to limit vertical movement along said respective side member when said first and second arms are engaged with said forward and rearward facing edges of said respective side member, said first and second arms being movably mounted to said shelf and being movable via movement of said handle; and wherein said shelf is positionable between said side members at a desired location, and wherein said handle is movable to engage said first arm with said forward facing edge and said second arm with said rearward facing edge to substantially clamp said respective side member between said first and second arms, with one of said arms engaging at least one of said protrusions at least one of said forward and rearward facing edges to limit vertical movement of said shelf along said side members when said respective side member is substantially clamped between said first and second arms.

2. The display assembly of claim 1, wherein said shelf includes a mounting assembly at each end of said shelf, each mounting assembly engaging said forward and rearward facing edges of a respective one of said side members.

3. The display assembly of claim 1, wherein said first arm moves in response to movement of said handle and said second arm moves in response to movement of said first arm.

4. The display assembly of claim 1, wherein each of said forward and rearward facing edges of said respective side member comprises a plurality of protrusions spaced therealong and each of said first and second arms is configured to engage at least one of said protrusions at said forward and rearward facing edges of said respective side member.

5. The display assembly of claim 4, wherein said first arm is slidably mounted to said shelf and said second arm is pivotally mounted to said shelf.

6. The display assembly of claim 5, wherein pivotal movement of said handle imparts translational movement of said first arm, which in turn imparts pivotal movement of said second arm to engage said arms with said protrusions.

7. The display assembly of claim 4, wherein said first arm includes an aperture for receiving a selected one of said protrusions therethrough.

8. The display assembly of claim 7, wherein said second arm includes an open slot for receiving a selected one of said protrusions therethrough.

9. The display assembly of claim 1, wherein said shelf comprises a shelf base and a shelf tray movably attached to said shelf base, said mounting assembly being mounted to a lower portion of said shelf base.

10. The display assembly of claim 9, wherein said shelf tray is slidably and pivotably attached to said shelf base.

11. The display assembly of claim 1, wherein said side members comprise first and second side members with at least one shelf mounted thereto, said display assembly including third and fourth side members with at least one shelf mounted thereto, said third side member being adjacent to and connected to said second side member.

12. The display assembly of claim 11 including a product tray module attachable to a forward portion of said second and third side members to substantially conceal at least a portion of said forward facing edges of said second and third side members.

13. The display assembly of claim 1, wherein each of said side members comprises two or more side member sections longitudinally aligned and connected together.

14. The display assembly of claim 13, wherein said side member sections are connected together via a connecting element that is received within and partially along a slot at each of said side member sections.

15. The display assembly of claim 1 including a header portion attachable to an upper end of each of said side members.

16. The display assembly of claim 15, wherein said header portion includes at least one illumination source and one of said side members supports a power connector disposed thereat, said illumination source being powered via electrical connection to said power connector.

17. A display assembly for displaying merchandise, said display assembly comprising:

a pair of opposite side members, a first one of said side members having a forward facing edge and a rearward facing edge, said forward and rearward facing edges comprising a plurality of protrusions spaced therealong;

at least one shelf adjustably mounted to said side members;

said shelf including a mounting assembly at an end thereof, said mounting assembly comprising a handle and first and second arms for engaging said forward and rearward facing edges of said first side member to mount said shelf to said side members, said first and second arms being movably mounted to said shelf and being movable via movement of said handle;

said first arm being configured to engage at least one of said protrusions at said forward facing edge of said first side member and said second arm being configured to engage at least one of said protrusions at said rearward facing edge of said first side member to limit vertical movement along said first side member when said arms are engaged with said forward and rearward facing edges of said first side member; and wherein said shelf is positionable between said side members at a desired location and said arms are positioned at selected ones of said protrusions of said first side member, said handle being movable to engage said first arm with said forward facing edge and said second arm with said rearward facing edge to substantially retain said first side member between said arms.

18. The display assembly of claim 17, wherein said shelf includes a mounting assembly at each end of said shelf, each mounting assembly engaging said forward and rearward facing edges of a respective one of said side members.

19. The display assembly of claim 17, wherein one of said first and second arms moves in response to movement of said handle and the other of said first and second aims moves in response to movement of said one of said first and second arms.

20. The display assembly of claim 17, wherein said first arm is slidably mounted to said shelf and said second arm is pivotally mounted to said shelf.

21. The display assembly of claim 20, wherein pivotal movement of said handle imparts translational movement of said first arm, which in turn imparts pivotal movement of said second arm to engage said arms with said protrusions.

22. The display assembly of claim 20, wherein said first arm includes an aperture for receiving a selected one of said protrusions therethrough.

23. The display assembly of claim 22, wherein said second arm includes an open slot for receiving a selected one of said protrusions therethrough.

24. The display assembly of claim 17, wherein said shelf comprises a shelf base and a shelf tray movably attached to said shelf base, said mounting assembly being mounted to a lower portion of said shelf base.

25. The display assembly of claim 24, wherein said shelf tray is slidably and pivotably attached to said shelf base.

26. The display assembly of claim 17, wherein said side members comprise first and second side members with at least one shelf mounted thereto, said display assembly including third and fourth side members with at least one shelf mounted thereto, said third side member being adjacent to and connected to said second side member.

27. The display assembly of claim 26 including a product tray module attachable to a forward portion of said second and third side members to substantially conceal at least a portion of said forward facing edges of said second and third side members.

28. The display assembly of claim 17, wherein said side members comprise two or more side member sections longitudinally aligned and connected together.

29. The display assembly of claim 28, wherein said side member sections are connected together via a connecting element that is received within and partially along a slot at each of said side member sections.

30. The display assembly of claim 17 including a header portion attachable to an upper end of said side members.

31. The display assembly of claim 30, wherein said header portion includes at least one illumination source and one of said side members supports a power connector disposed thereat, said illumination source being powered via electrical connection to said power connector.

32. A display assembly for displaying merchandise, said display assembly comprising:

first and second side members, each of said first and second side members having a forward facing edge and a rearward facing edge;

at least one shelf adjustably mounted to said first and second side members;

said shelf including a mounting assembly at an end thereof, said mounting assembly comprising a handle and first and second arms for engaging said forward and rearward facing edges of said first side member to mount said shelf at said side members, wherein said first and second arms are movably mounted to said shelf and are movable via movement of said handle;

wherein at least one of said arms is configured to limit vertical movement along said first side member when said first and second arms are engaged with said forward and rearward facing edges of said first side member; and wherein said shelf is positionable between said side members at a desired location, and wherein said handle is movable to engage said first arm with said forward facing edge of said first side member and said second arm with said rearward facing edge of said first side member to substantially clamp said first side member between said first and second arms and to limit vertical movement of said shelf along said side members when said respective side member is substantially clamped between said first and second arms.

33. The display assembly of claim 32, wherein said first arm and said forward facing edge of said first side member comprise movement limiting means that engage one another to limit movement of said first arm along said forward facing edge of said first side member when said respective side member is substantially clamped between said first and second arms.

34. The display assembly of claim 32, wherein said second arm and said rearward facing edge of said first side member comprise movement limiting means that engage one another to limit movement of said second arm along said rearward facing edge of said first side member when said respective side member is substantially clamped between said first and second arms.

35. The display assembly of claim 32, wherein said shelf includes a mounting assembly at each end of said shelf, each mounting assembly comprising a handle and first and second arms for engaging said forward and rearward facing edges of a respective one of said side members.

* * * * *

UNITED STATES PATENT AND TRADEMARK OFFICE
Certificate

Patent No. 7,950,538 B2

Patented: May 31, 2011

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Dathan G. Zang, Grand Haven, MI (US); Gregory D. Gavin, Grand Haven, MI (US); Thomas J. Nook, Grand Haven, MI (US); and Vincent C. Migliore, Goochland, VA (US).

Signed and Sealed this Twenty-seventh Day of December 2011.

DARNELL M. JAYNE
*Supervisory Patent Examiner*
Art Unit 3637
Technology Center 3600

UNITED STATES PATENT AND TRADEMARK OFFICE

CERTIFICATE OF CORRECTION

PATENT NO. : 7,950,538 B2
APPLICATION NO. : 11/602791
DATED : May 31, 2011
INVENTOR(S) : Dathan G. Zang et al.

It is certified that error appears in the above-identified patent and that said Letters Patent is hereby corrected as shown below:

Column 1
Line 50, Insert --at-- after "assembly"

Column 14
Line 59, Claim 1, Insert --at-- after "assembly"

Column 15
Line 11, Claim 1, Insert --at-- after "protrusions"

Column 16
Line 44, Claim 19, "aims" should be --arms--

Signed and Sealed this
Seventeenth Day of April, 2012

David J. Kappos

David J. Kappos
*Director of the United States Patent and Trademark Office*